US007518051B2

(12) United States Patent
Redmann

(10) Patent No.: US 7,518,051 B2
(45) Date of Patent: Apr. 14, 2009

(54) METHOD AND APPARATUS FOR REMOTE REAL TIME COLLABORATIVE MUSIC PERFORMANCE AND RECORDING THEREOF

(76) Inventor: William Gibbens Redmann, 1202 Princeton Dr., Glendale, CA (US) 91205

( * ) Notice: Subject to any disclaimer, the term of this patent is extended or adjusted under 35 U.S.C. 154(b) by 49 days.

(21) Appl. No.: 11/506,569

(22) Filed: Aug. 18, 2006

(65) Prior Publication Data

US 2007/0039449 A1 Feb. 22, 2007

Related U.S. Application Data

(60) Provisional application No. 60/709,651, filed on Aug. 19, 2005.

(51) Int. Cl.
*G10H 1/00* (2006.01)

(52) U.S. Cl. ..... 84/601; 84/609

(58) Field of Classification Search ..... 84/609–612, 84/615, 622, 649, 653, 659, 600–602
See application file for complete search history.

(56) References Cited

U.S. PATENT DOCUMENTS

| | | | | |
|---|---|---|---|---|
| 6,653,545 | B2 * | 11/2003 | Redmann et al. | 84/615 |
| 2004/0221709 | A1 * | 11/2004 | Tonet | 84/602 |
| 2006/0130636 | A1 * | 6/2006 | Toledano et al. | 84/600 |
| 2007/0163428 | A1 * | 7/2007 | Salter | 84/611 |

* cited by examiner

*Primary Examiner*—David S. Warren

(57) ABSTRACT

An improved method and apparatus are disclosed to permit real time, distributed performance by multiple musicians at remote locations, and for recording that collaboration. The latency of the communication channel is transferred to the behavior of the local instrument so that a natural accommodation is made by the musician. This allows musical events that actually occur simultaneously at remote locations to be played together at each location, though not necessarily simultaneously at all locations. This allows locations having low latency connections to retain some of their advantage. Artifacts resulting from an unreliable communication channel, for instance dropouts and jitter, are eliminated in the recorded performance. Limitations of communications bandwidth are managed in real time, with full fidelity restored in the recording.

20 Claims, 9 Drawing Sheets

METHOD AND APPARATUS FOR REMOTE REAL TIME COLLABORATIVE MUSIC PERFORMANCE AND RECORDING THEREOF

CROSS REFERENCE TO RELATED APPLICATIONS

This non-provisional patent application claims priority of the like-named provisional application No. 60/709,651 filed with the USPTO on Aug. 19, 2005.

FIELD OF THE INVENTION

The present invention relates generally to a system for electronic music performance. More particular still, the invention relates to a system for permitting participants to collaborate in the performance of music, i.e. to jam, where any performer may be remote from any others, and to record that collaboration, overcoming bandwidth limitations and unreliable communications.

STATEMENT REGARDING FEDERALLY SPONSORED RESEARCH OR DEVELOPMENT

Not Applicable

REFERENCE TO COMPUTER PROGRAM LISTING APPENDICES

Not Applicable

BACKGROUND OF THE INVENTION

In U.S. Pat. No. 6,067,566, Moline teaches a method whereby a live musical performance, preferably encoded as well known Musical Instrument Digital Interface (MIDI) commands, can be sent over a network to many stations. The live performance can be selectively recorded or mixed with other pre-recorded tracks. The mechanism is a timestamp that is attached to each musical event (e.g. a MIDI Note-On command). By sequencing the timestamps from separate tracks, the tracks can be mixed. By delaying the mixing for at least the maximum expected delay of the communication channel, the (almost) live musical performance can be added to the pre-recorded tracks at a remote location. Further, a station receiving this performance can play along with the (almost) live performance. Moline is limited, however, in that the "play along" performance is not bi-directional. That is, a true jam session is not taking place. Moline suggests that a repetitive musical pattern could be established and enforced, and that jamming could take place by having each participant hear and play along with the others' performance from one or more prior cycles of the pattern. That play along performance is what would subsequently be heard by the others, during the next (or later) cycle. Such a constraint severely limits the range of artistic expression.

In U.S. Pat. No. 6,653,545, Redmann, et al. teach an alternative method and apparatus which permit real time, distributed performance by multiple musicians at remotely located performance stations. They show how the latency of the communication channel interconnecting the performance stations is measured and added to the behavior of a local electronic musical instrument so that a natural accommodation may be made by the local musician. Specifically, a local-only delay is introduced between the time that a musical note is played by the local musician at a performance station and the time that it is locally sounded. This delay is selected to be significantly representative of the delay inherent in the communication channel. However, the musical note is immediately sent to the remote performance station, and when received is essentially played immediately. In this manner, the notes are played at both stations at substantially the same time.

Timestamps

Moline above, and Neumann, et al. in U.S. Pat. No. 6,175,872 both teach the use of timestamps associated with MIDI data transmitted over a network as a mechanism for ordering the musical events and causing them to play at the appropriate time.

Moline requires that playback be held off for at least the maximum expected network delay in order to assure proper playback. This is not compatible with the requirements for a real time jam.

Neumann et al. identify timestamps as a means whereby musical events "from any remote site can be time positioned in the proper relative time sequence with respect to all the received MIDI data." However, this does not enable a real time jam, except in special situations where "the network delays must be small enough to be insignificant to the playing." Since Neumann et al. specify use of TCP/IP protocol, all musical event data will be received in order, however situations where a retransmission of a lost packet is required will seriously compromise a real-time jam. Neumann neither admits nor addresses this. However, Neumann does recommend the Network Time Protocol (NTP) as a means for synchronizing the clocks of remote stations contributing musical data.

However, even the well-regarded NTP is not entirely sufficient for synchronization. NTP is described in the specification *RFC* 1305—*Network Time Protocol* (*Version* 3) *Specification, Implementation and Analysis* by the Internet Activities Board of the Defense Advanced Research Projects Administration (DARPA). The RFC claims that NTP "provides the protocol mechanisms to synchronize time in principle to precisions in the order of nanoseconds." Empirical testing suggests that NTP-based system clock synchronization as implemented in commercial operating systems such as Windows XP by Microsoft Corporation of Redmond, Wash. and Mac OS-X by Apple Computer of Cupertino, Calif. for personal computers exhibit both absolute time errors and significant drift. Their implementations of the NTP standards are wholly adequate for time-of-day functions, managing file directories and dating emails. However, combined with the hardware limitations of personal computers—especially those recently turned on or otherwise in a thermally unstable situation causing extreme clock drift—consumer grade operating systems commonly result in computer clocks which diverge from each other at rates of several seconds per day. This, in the real-time situation, represents drifts in excess of several milliseconds per minute. A drift rate such as this is incompatible with a need for time stamping real-time musical events for a remote jam, as within a few minutes one remote station may drift out of synch resulting in musical events arriving with timestamps apparently too old to be considered acceptable for live playback, even though this is not truly the case.

Bandwidth Limitations

Of musicians using the Musical Instrument Digital Interface (MIDI) preferred by both-Moline and Redmann et al., the majority employ a piano-style keyboard instrument. However, a variety of devices exist to allow the creation of MIDI events using or simulating other classes of musical instruments such as MIDI drums, electronic wind instruments (EWI) e.g. an electronic saxophone, electronic valve instruments (EVI) e.g. an electronic trumpet, and guitar-to-MIDI converters which adapt an electric guitar to generate MIDI events.

Though MIDI keyboards and MIDI drums usually generate a relatively moderate quantity of MIDI data, such is usually not the case with the other controller types. There is great expressiveness possible when combining fingering, breath, bite, and thumb controls on EWI and EVI instruments. Guitar-to-MIDI converters detect each of the strings separately, and follow the guitarist's bending of them individually. These non-keyboard and non-drum instruments commonly generate a larger number of MIDI events.

As the number of participants in a network jam increases, and as the average number of MIDI events produced by each participant increases, the aggregate traffic from a network jam may run into the bandwidth limits of one or more of the participants, resulting in more events being generated than can timely be received. A mechanism and method for controlling such an overload is needed.

Clean-Up

A side effect of such an overload will be that packets, if not substantially delayed, will be dropped. Further, the very protocols designed for low-latency real-time use, such as UDP/IP common on the Internet, are not reliable—typical figures would have one packet in one hundred being dropped. For whatever reason, a dropped packet can result in significantly undesirable performance: if a note-on event is missed, the note goes unheard; worse, if a note-off event is missed, the note is stuck on and sounds indefinitely.

There is a need to mitigate the effects of dropped packets both in real-time live performance, and in a performance captured for playback or manipulation at a later time.

Recording

Historically, recording studios are operated by an individual designated as the engineer. An engineer captures music made by musicians performing their art unfettered by the technical tasks associated with recording devices (the transport). The engineer supplies adequate blank media, advances or rewinds the transport to appropriate positions, selects certain channels for playback to accompany subsequent performances, and finally archives the "master" for duplication and later manipulation in the mixdown.

While such sophistication is not required to have a satisfying real-time jam experience, it is necessary if the remote performances are to be produced into a finished product.

A means is needed for providing recording studio-like functionality for a real-time remote collaboration.

MIDI Machine Control (MMC) is an established standard for manipulating the controls of a transport by using MIDI events. The standard is published in *Complete MIDI* 1.0 *Detailed Specification* by the MIDI Manufacturers Association, Inc. of Los Angeles, Calif. However, simply advancing MMC commands such as RECORD, STOP, etc. to remote stations, and making use of extant recording hardware or software is not adequate to provide a usable, collaborative recording environment. Available recording devices and software (also known as "sequencers" or "sequencing software") are not aware of "lossy" channels such as expected in a real-time network jam. The cleanup mechanisms described below are not well served by prior art recording mechanisms. Further, the distributed nature of the remote collaboration calls for a similarly distributed transport mechanism to record locally the live performance of each musician, in full fidelity, and subsequently reintegrate those recordings into a master record of the musical collaboration.

OBJECTS AND SUMMARY OF THE INVENTION

When properties of the communication channel are that delivery of messages is unreliable and delivery times are uncertain, as with the Internet, the quality of a distributed performance under Redmann et al. can suffer. A way to mitigate dropped messages without suffering the added delay inherent in reliable protocols is needed.

When the capabilities of the communication channel, or an individual remote station's communication channel interface, is insufficient to timely carry the musical events representative of a musician's live performance, the need exists to moderate the number of events while minimally compromising the qualities of the live performance.

Further, having mitigated the above-mentioned events dropped due to network unreliability or those redacted so as not to exceed bandwidth limits, there is a need to correct the imperfections introduced into the real-time performance, so that an accurate record of the original, unperturbed performance by each musician is available.

Additionally, there exists a need for an equivalent to the classic recording studio process, whereby musicians can easily collaborate in real-time from remote stations, yet manage a recording of their performance to obtain a recording made of the real time jam from any of the stations.

The present invention satisfies these and other needs and provides further related advantages.

The present invention relates to a system and method for playing music with one or more other musicians, that is, jamming, where some of the other people are at remote locations, as described in Redmann et al., U.S. Pat. No. 6,653,545.

Each musician has a station, typically including a keyboard (as in the cited patent by Redmann et al., used herein to include any form of a MIDI controller, unless otherwise indicated), computer, synthesizer, and a communication channel. The communication channel might be a modem connected to a telephone line, a DSL connection, or other local, wide, or Internet network connection.

When musicians desire a jam session, their respective station computers communicate with each other, or perhaps with a designated host computer.

Individual stations synchronize to a common clock, perhaps the system clock of one of the stations themselves. The synchronized local clock is preferably implemented as a model of the common clock derived from a predictor-corrector function of the local clock, including drift estimation, updated and maintained through frequent measurement and error estimations. This process is well known and quite similar to the synchronization algorithms used in the NTP standard, but implemented with an unusually high update rate.

Subsequently, each musician's performance is immediately transmitted to every other musician's station. Each transmitted musical event is timestamped by the sender with a future time of the common clock at which the musical event is to occur. Typically, this time will be as far in the future as the greatest network delay associated with local station, and for most musicians, may comfortably be as high as 50 mS, though for certain musicians, especially pipe organists, the delay can be much higher (250 mS, or more!). The performance is delayed before being played locally by the same amount of time.

Upon receipt, remote performance events are delayed until their timestamp corresponds with the current common clock value. If a remote performance event is received with a timestamp representing a common clock value that has already passed, then the musical event is selectably played or not, according to the degree of lateness, nature of the musical event, and preferences of the receiving musician.

By this method, each musician's local performance is kept in time with every other musician's performance (as in Redmann et al.) during the real-time collaboration.

If the musicians decide to record their performance, a cleanup process is provided whereby any deviations from a musician's actual performance induced by communication channel dropouts or bandwidth limitations are repaired in non-real time. Several methods for achieving this may be used. Preferably, a complete record of the local performance is reliably sent once recording has ceased. One alternative is to sending a complete local performance as a continuing reliable stream throughout the performance, for example, as can be achieved with TCP/IP when the communication channel is the Internet. The complete record of the local performance may be sent in a non-real-time, timestamped transmission as taught by Neumann et al. Alternatively, the transmission may be in the format of a standard MIDI file, also described in the *Complete MIDI* 1.0 *Detailed Specification*, previously cited.

Preferably, one of the remote stations is designated as the engineer's station. It is the sole privilege and responsibility of the engineer to operate the distributed transport (or simply, 'transport'), the recording mechanism for the distributed collaboration. The operation of the transport is analogous to that of a tape recorder or MIDI sequencer. As such, the transport accepts such commands as record, stop, play, pause, rewind, and fast forward. When recording, all musical events produce at any of the participating remote stations is captured, and ultimately compiled, preferably at each remote station so that all of the participants have a complete record of the collaboration. In the alternative, it is not a technical requirement for the transport to have a single point of control at the engineer's station, but a sociological requirement of the "too many cooks" variety. The distributed transport can respond to control signals issued from any of the remote stations.

Pursuing the analogy of a studio recording process, the distributed transport preferably has capabilities for multitrack, multi-take recording, and a variety of controls having distributed or local significance, including mute, solo, monitor level, record select, and others described below.

The distributed transport is capable of providing the "groove" track, described in Redmann et al., that provides a framework for the jam session. In its simplest form, the framework might be a metronome. The distributed transport is additionally capable of recording. For the portion of the transport operation corresponding to the "groove" track, regardless of the communication delays, the groove will play in synchrony on all remote stations. Live performances played to the groove, however, may suffer temporary degradation as a result of network conditions. However, once the recording is finished and cleanup completed, the recorded performance will be without network-induced blemish.

It is the object of this invention to make it possible for a plurality of musicians to perform and collaborate in real time, even at remote locations, and produce flawless recordings of that collaboration.

In addition to the above, it is an object of this invention to limit aberrations induced by bandwidth limitations to a minimum. Some musical events have a more pronounced effect than others. Events with less pronounced effect often represent finesse of a musician. A note-on or note-off event has a pronounced effect. However, after-touch or pitchbend events have a more subtle impact. Further, since after-touch, pitchbend and the like can occur many times for each note-on, the effect of missing a single 'finesse' event is expected to be minor. If bandwidth limitations are encountered, these finesse events can be thinned, or reduced in number. By throttling back the frequency of updates allowed for such events, bandwidth overruns can be avoided, critical events can always be transmitted timely, and the full, rich expression originally intended by the musician can still be captured in a recording and transmitted to remote stations during the cleanup.

It is a further object of this invention to limit aberrations induced by the unreliable network to a minimum. In cases where a note-on event is dropped, the error is non-recoverable in real-time, but often unnoticed. However, in the equally likely situation where a note-off event is dropped, the corresponding note continues to sound indefinitely, making this a prominent, long persisting error. To remedy this, each remote station tracks the status of which of its notes are locally on. In the frequent circumstances where a station's status reflects that all notes are off, the station can transmit the observation to all remote stations. Receipt of such a message, though often redundant, is sufficient to correct the 'stuck note' problem in real-time. Such a message is not required in the complete record sent to cleanup the real-time performance.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

The aspects of the present invention will be apparent upon consideration of the following detailed description taken in conjunction with the accompanying drawings, in which like referenced characters refer to like parts throughout, and in which.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE INVENTION

Figure 1:
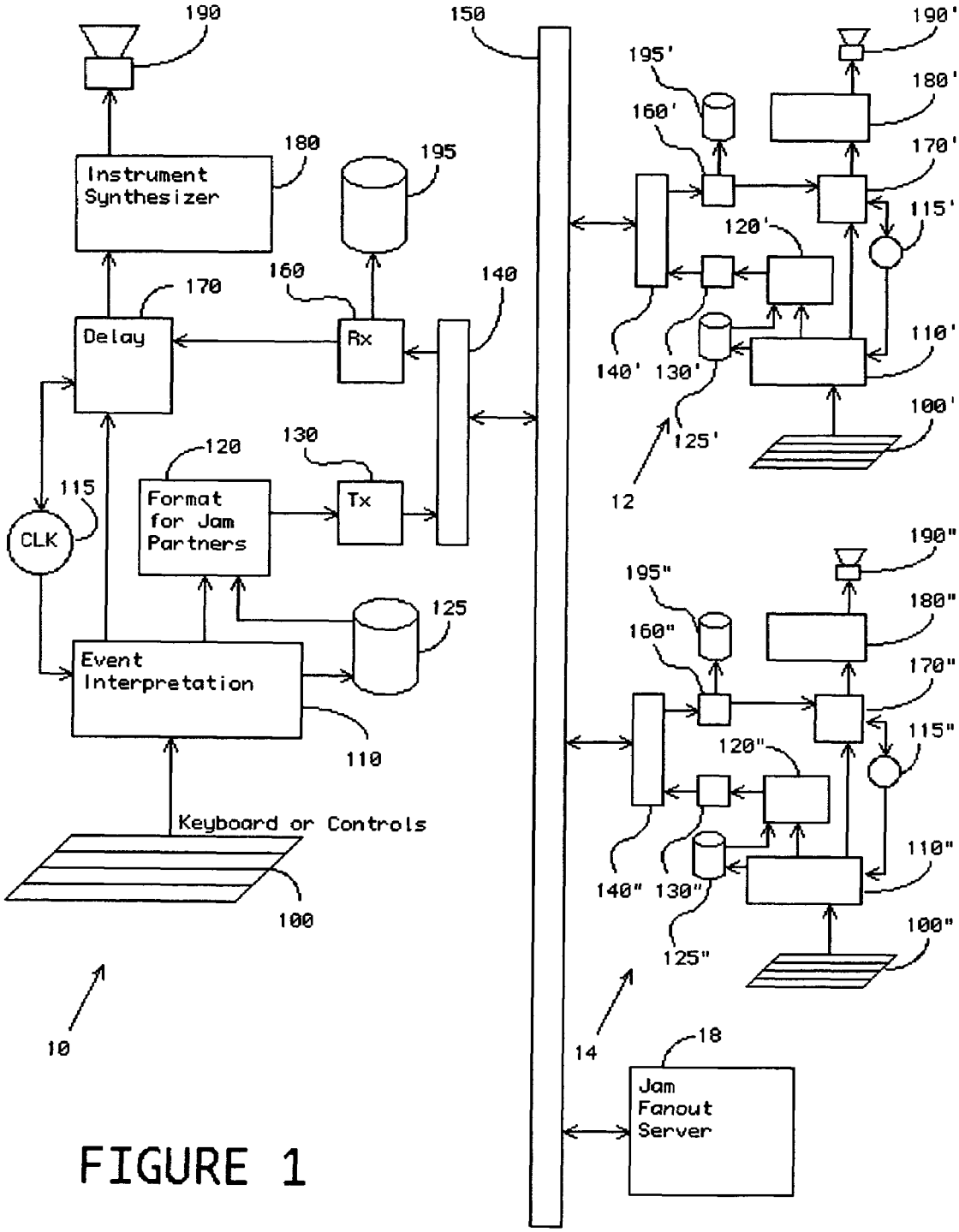
FIG. 1 is a detailed block diagram of multiple musical performance stations configured to jam over a communications channel, and including an optional server.

Referring to FIG. 1, a plurality of performance stations represented by stations 10, 12, and 14 are interconnected by the communication channel 150. The invention is operable with as few as two, or a large number of stations. This allows collaborations as modest as a duet played by a song writing team, up to complete orchestras, or larger. Because of the difficult logistics of managing large numbers of remote players, this invention will be used most frequently by small bands of two to five musicians.

Note that while the term "musician" is used throughout, what is meant is simply the user of the invention, though it may be that the user is a skilled musical artist, a talented amateur, or musical student.

For some implementations, a jam fanout server 18 is used. Each performance station 10, 12, 14 communicates over communication channel 150 directly with fanout server 18. Jam fanout server 18 is responsible for forwarding all pertinent communications from any of the performance stations to each of the others.

Communications channel 150 may be a telephone network, a local or wide area Ethernet, the Internet, or any other communications medium. It may include wireless segments (not shown).

In FIG. 1, each of remote performance stations 12 and 14 mirror the elements of local performance station 10. Each of performance stations 10, 12 and 14 have keyboard and controls 100, 100', 100", event interpretation 110, 110', 110", shared clock 115, 115', 115", event formatting for jam partners 120, 120', 120", local recorded channel storage 125, 125', 125", transmit module 130, 130', 130", communication channel interface 140, 140', 140", receive module 160, 160', 160", delay 170, 170', 170", instrument synthesizer 180, 180', 180", audio output 190, 190', 190", and remote recorded channel storage 195, 195', 195", (which may be synonymous with local recorded channel storage 125, 125', 125"), all respectively.

Each performance station is preferably comprised of a personal computer having a keyboard and controls 100. Other common graphical user interface (GUI) controls, such as on-screen menus and buttons operated with a mouse or trackball, are included in keyboard and controls 100, but not specifically illustrated here.

Certain keys of keyboard 100 may be mapped to certain musical notes.

The keys of keyboard 100, when operated, generate events. When a musician presses a key on the keyboard, a "key pressed down" event is generated. When the musician lets go of the key, a "key released" event occurs. Similarly, if the computer's mouse is clicked on an on-screen button, a "button pressed" event is generated.

A more expensive alternative to the computer keyboard is a MIDI controller. Usually resembling a piano keyboard, though often smaller and covering fewer octaves, a MIDI controller is more intuitive and musically friendly than the computer keyboard. When combined with a MIDI interface for the computer, such as the one provided with well-known audio cards such as Creative Labs' Sound Blaster, the MIDI controller can generate events in place of or in addition to keyboard and controls 100.

Modern MIDI controllers include those that resemble the interface of musical instruments other than a piano. There exist MIDI controllers that generate musical events from a musician's guitar performance, such as the G-50 manufactured by Roland Corporation U.S. of Los Angeles, Calif. and the GI-20 manufactured by Yamaha Corporation of America of Buena Park, Calif. MIDI events generated by these devices are best rendered on their companion instrument synthesizers 180, Roland's XV 2020 and Yamaha's MU 90R, respectively. MIDI can be generated with a drum-interface MIDI controller, such as Roland's V-Drums. Additionally, devices that are played like wind or valve instruments, but generate MIDI controller signals, are also available.

Importantly, if one or more MIDI controllers are added to the keyboard and controls 100, it becomes possible for more than one musician to perform at a single performance station 10. That is, if a single MIDI controller is added to performance station 10, then one musician could play the MIDI controller, and another musician could play using the computer keyboard. Each additional MIDI controller added to keyboard and controls 100 can potentially allow an additional musician to play at the local performance station. Throughout this discussion, references to the musician using a performance station will be understood to include the possibility of multiple musicians performing on that single performance station.

Each of the stations 10, 12, and 14 may be identical, or may have different keyboard and controls 100, 100', 100" as described above.

Hereinafter, when relating to the generation of a musical event, the term "keyboard" may be used to refer to the computer keyboard, a MIDI controller (whether keyboard, guitar, drum, wind, valved, or other interface), or the GUI or other controls.

When an event is generated by keyboard and controls 100, whether from a computer keyboard, MIDI controller, or a mouse action, the event is interpreted. Event interpretation 110 examines the event to determine whether it has significance to the musical performance.

An example of a significant event would be "key pressed", where the key has been given an association with a musical note that should be played. A "key released" for the same key would mean that the note, if playing, should be stopped. The same is true if the event comes from the MIDI controller.

An example of a non-significant event would be a "key pressed", where the key is not assigned to a note.

A refinement of event interpretation 110, fulfilling an object of the present invention, is event 'thinning'. Certain musical event may be determined to be less necessary in a live collaboration. This can be important, for instance, if the aggregate stream into or out of communication channel interface 140 might exceed bandwidth limitations. Or, if the number of events being communicated threatens to cause musical events of greater importance an undesirable delay. Event thinning is discussed in more detail in conjunction with FIG. 7.

An additional refinement of event interpretation 110 is that each musical event is preferably combined with the current value of shared clock 115. This permits each event to be scheduled for enunciation at a particular time relative to the shared clock. This allows musical events to be transmitted across implementations of communication channel 150 where the transport latency varies, yet still be played in time with great precision. Should the transport of an event take too long, the excessive latency can be directly measured off the shared clock and the musical event can be suppressed.

The implementation of a shared clock is well known. However, in the case of an accurate shared clock that relies on relatively low-quality crystal clocks lacking temperature compensation, such as those typical employed in personal computers, care should be taken to aggressively monitor and correct for drift. Further, whereas a software application implementing the present invention is likely to be running without the necessary permission to alter the system clock (and further, where such an alteration of the clock might be deemed inappropriate by the owner of the PC), shared clock 150, while reliant on the local timebase, is preferably distinct from the system clock (not shown). The sole exception to this may be that of the collaborating performance stations 10, 12, and 14, a single one, say station 10, may use its system clock as the reference clock for all the shared clocks 150, 150', 150". A reasonable way for the reference clock to be selected is to require the first performance station to join to supply the reference clock. Other methods are well known, such as selecting the reference clock having the highest known quality, nearest access to an authoritative clock, or closest performance to the average behavior of the participating system clocks. Any such method will produce acceptable results.

Once a reference clock is select, for example the system clock of station 10, the local shared clock 115 is exactly identical to that clock. Causing other shared clocks 115' and 115" to closely synchronize to that clock is a well known procedure, but because of the low quality of clocks, one that requires frequent monitoring and updates, as discussed in conjunction with FIG. 3, below.

Events determined to be musically significant by Event Interpretation 110, are immediately sent two places: Musical events are formatted for the jam partners at 120, and subsequently the transmit module 130 packages the musical events for the communication channel, possibly merging them with packets from other sources (not shown, discussed below), and advances them via the communication channel interface 140 to the communication channel 150. Also, the musical events are directed to the local instrument synthesizer 180 by way of delay 170, discussed below, to be rendered by audio output 190. If event thinning is in effect, events identified as being less necessary are not immediately sent to the transmit module. Optionally, events identified as being less necessary are not sent to delay 170, either. This allows a musician to hear locally the effect that thinning is having on his live performance as distributed to the remote performance stations.

Whether or not thinning is in effect, if a performance is being recorded (discussed below in conjunction with FIG. 4 and others), all of the musically significant events from keyboard 100 are recorded in local recorded channel storage 125. This ensures, even if events have been thinned, if they are suppressed due to excessive latency, or if they are lost, for example in transit over communications channel 150, that a complete record of the events is retained. Later, this complete record can be exchanged with the remote performance stations 12 & 14, in the cleanup process 800 discussed in conjunction with FIG. 8.

Distributed multi-player game software is well known in the art. Those in the field of computer games will be familiar with IGN Entertainment Inc., of Brisbane, Calif. and their GameSpy toolkit product line, a collection of APIs specifically designed for cross-platform multi-player games on modern personal computers, including the Macintosh product line by Apple Computer, Inc. of Cupertino, Calif., and PC compatible machines running the Windows XP operating system by Microsoft Corporation, Redmond, Wash. In-the "GameSpy Transport SDK 2" (GT2) API, such an implementation, the formatting for jam partners 120 preferably consists of a single call to the "gt2Send" method for each musical event. Data representative of the musical event is provided to the method, along with a command code to send the event data to all other stations participating in the jam.

When implemented using GameSpy's APIs, the transmit module 130 is comprised of elements of the underlying operating system and GT2 (and for some functions, the GameSpy Peer SDK's Peer object).

The GameSpy APIs don't support direct serial or direct connect modem modes, however such connections readily available, for example by using Microsoft's DirectX real time extensions, including DirectPlay—Microsoft's extension for distributed multi-player games. DirectPlay, however, is not well suited to cross-platform implementations. A DirectPlay session can operate with any of several interconnection technologies, including serial, modem, and TCP/IP, among others.

GameSpy's API notwithstanding, an implementation of the functionality of the gt2Send method (or DirectPlay's "SendTo" method) is within the capability of a programmer of ordinary skill, just writing directly to the transmit module 130 as a managed buffer for the communication channel interface 140. Similarly, an implementation of the receiver module 160 without the GameSpy library is within the capability of the programmer of ordinary skill.

While many other alternative implementations of the communications channel 150 can be selected, the following discussion covers the most advantageous specific case: where the communications channel 150 is implemented as an IP network, such as the Internet. Examples of implementations not discussed in detail include telephone and RS-232 serial networks, where a jam fanout server 18 is required for a jam having more than two participating performance stations); RS-485 or similar multi-drop serial networks, where a jam fanout server 18 is not required; a packet radio network; and other form of LAN or WAN networks, such as token ring, or IPX. This list is not intended to limit the scope of the present invention, but merely to illustrate that essentially any communication channel can be used.

In an implementation where communication channel 150 is an IP network, then transmit module 130 includes the IP stack, and perhaps other software as previously mentioned. Communication channel interface 140 may be a modem dialed into an Internet Service Provider (ISP) and operating the Point-to-Point Protocol (PPP) to connect with and use the Internet as communication channel 150; a cable modem, DSL, wireless, or other communication technology can also be used. Interface 140 may be a network interface card (NIC), connected, for example, using 10 baseT to reach a hub or router. Whether the IP network actually connects to the Internet, or merely to a private network, the invention is operational if musicians at the participating stations 10, 12, and 14 can interconnect over the communications channel 150. When connecting over an IP network, each performance station 10, 12, and 14 may send musical event messages directly to each of the others. Alternatively, a jam fanout server 18 may be used. Another alternative is to use a multicast protocol to send each message to the other stations.

In an implementation using a jam fanout server 18, it is necessary for each participating performance station to know how to contact the fanout server 18, and how to inform the fanout server of the interconnection desired.

Regardless of the implementation of communication channel 150, performances stations 10, 12, and 14 are able to exchange musical event information. The following discussion assumes that the wide variety of implementations available is understood, and for clarity merely concerns itself with the management of the musical event messages, and the timing characteristics of the connection between each two stations 10, 12, and 14 over communication channel 150.

Packets are received by communication channel interface 140 and provided to receive module 160. Many kinds of packets may be seen, but only those representing live musical events from participating performance stations are advanced to delay 170 (discussed below), and ultimately played over instrument synthesizer 180 and audio output 190. The case of cleanup messages, discussed below in reference to FIG. 8, may be handled by remote recorded channel storage 195. Non-musical messages which do not qualify for the above treatments are handled by other means (not shown). In some alternative embodiments (discussed below), the same messages that are advanced to delay 170 may be stored in remote recorded channel storage 195, too, to provide a contemporaneous cleanup.

Several varieties of non-musical packets are contemplated, and serve to add functionality and versatility to this invention. Among the functions possible are an intercom, performance station state setting commands, and communication channel delay measurement. Each of these is discussed below. When receive module 160 gets one of these packets, it is handled in a manner described below.

Delay 170 receives musical events generated by the local musician (not shown) at local performance station 10, operating on the keyboard and controls 100 and accepted by event interpretation 110. It also receives musical events generated by remote musicians (not shown) at remote stations 12 and 14, using those keyboards and controls 100'and 100", which were processed similarly and communicated to performance station 10 as described above.

By a value that will be specified below, each musical event received by delay 170 is held for a (possibly null) period of time, before being provided to instrument synthesizer 180.

Delay 170 can be implemented as a scheduled queue, where each event entering the queue is given a delay time (to be defined below). The event is to remain in the queue for that delay time, and then be advanced from the queue to the instrument synthesizer 180.

One example implementation for delay 170 is to use a sorted queue. Upon receipt of a musical event by delay 170, the musical event is augmented with a future time value, calculated by adding a delay value (selected in a manner described below) to the current time. The musical event with the appended future time is inserted into the sorted queue in order of ascending future time. Delay 170 further operates to ensure that, at the time listed as the future time of the first event in the queue, the first musical event is removed from the queue and sent to the instrument synthesizer 180.

Preferably, but especially in an implementation where communication channel 150 or some other source subjects musical events to variable latency, local musical events from event interpretation 110, and remote musical events, for example those from remote performance stations 12 and 14, are provided to delay 170 already having a timestamp relative to shared clock 115, 115' or 115", respectively. In such an implementation, the addition of the delay value has already been performed by the originating performance station 10, 12, or 14, and the event is ready for insertion into a scheduled or sorted queue.

Alternatively, timestamps relative to the shared clocks 115, 115', and 115" may be translated into a delay or time value relative to a local system clock (not shown), if needed to take advantage of useful platform or API specific services. An example of such a service is provided by Microsoft's DirectX DirectMusic API. The future time is calculated relative to the local system clock, and passed as a parameter, along with the musical event data, to the appropriate DirectMusicPerformance method, for example the SendMIDIMSG method, to schedule musical events such as MIDI Note-On or Note-Off.

Many implementations of instrument synthesizer 180 are possible. The synthesizer can be entirely composed of software, as with the *SimpleSynth* synthesizer, published by Peter Yandell of Australia. Alternatively, a dedicated hardware synthesizer can be used, such as any of the Creative Labs Sound Blaster series, which is a card added to a personal computer. Some computers have integral synthesizers. Alternatively, if the computer is provided with a MIDI output port, the synthesizer can be external to the computer, and receive musical events as a MIDI stream coming from a MIDI output port. Further, the term "synthesizer" is not used in a limiting sense. Herein, it is used to indicate any controllable musical device. Examples include systems capable of waveform playback, such as audio samplers and media players, and even automated acoustic instruments such as a MIDI controlled player piano. True synthesizers, such as analog or FM-synthesizers (digital or analog) are also included.

The implementation details of any of these alternatives are within the capability of a programmer of ordinary skill. Further, Microsoft's DirectMusic API provides an implementation independent software interface to any of these options, as does Apple Computer's Core MIDI software, included as a part of their OS X operating system. The actual synthesizer arrangement can be selected by the musician operating the personal computer, and the application implementing the performance station determines the correct instrument synthesizer 180 at runtime.

While various mechanisms of synchronizing clocks over an Internet connection are well known, one is described here for clarity. Other techniques or algorithms may be used or adapted to the nature of the hardware found in consumer grade computers. In the following discussion, is important to note that neither station A nor C has access to omniscient information such as shown in FIG. 2 or FIG. 3, but that each station is exchanging information in an attempt to develop an adequate estimate the real situation.

Figure 2:
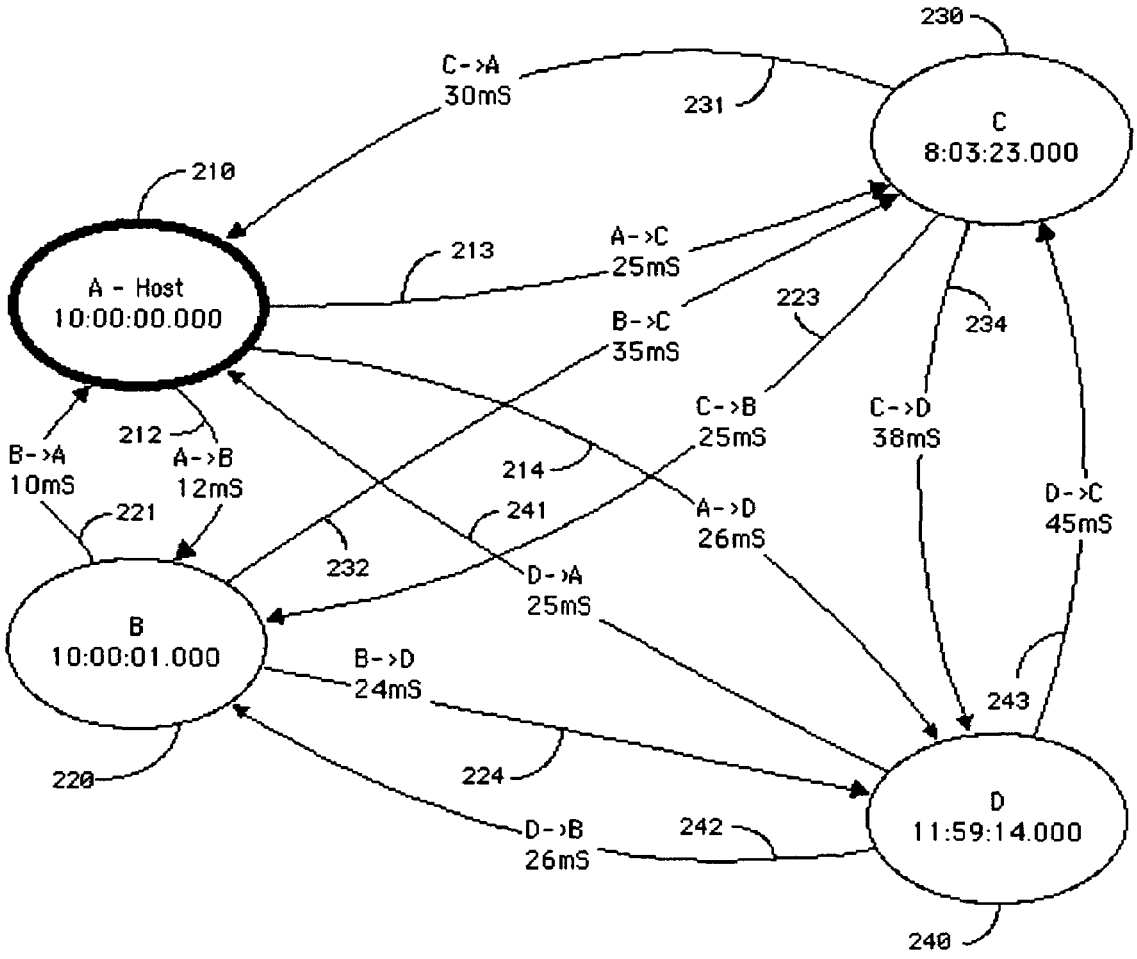
FIG. 2 is an omniscient view of multiple musical stations in a peer-to-peer connection, illustrating unsynchronized clocks and transport delays over each connection.

FIG. 2 illustrates a hypothetical situation wherein four performance stations: station A 210, station B 220, station C 230, and station D 240, are fully interconnected. The twelve individual one-way interconnections 212, 221, 213, 231, 214, 241, 223, 232, 224, 242, 234, 243 each represent communication connections that are conducted by communication channel 150. Further, in FIG. 2, each one-way interconnection is given a hypothetical typical latency. Station A 210, in bold, is designated as having the reference shared clock.

No regard is given for the exact nature of the communication channel 150, except that each performance station 210, 220, 230, and 240, can connect directly with any other. For topologies that include a fanout server 18, the following principles can be applied, however, they are not presented in that form. A fanout server 18 could be simply a message switch, or fanout server 18 could be the source of the reference for the shared clock, in which case it would participate as station A in the following discussion.

Figure 3:
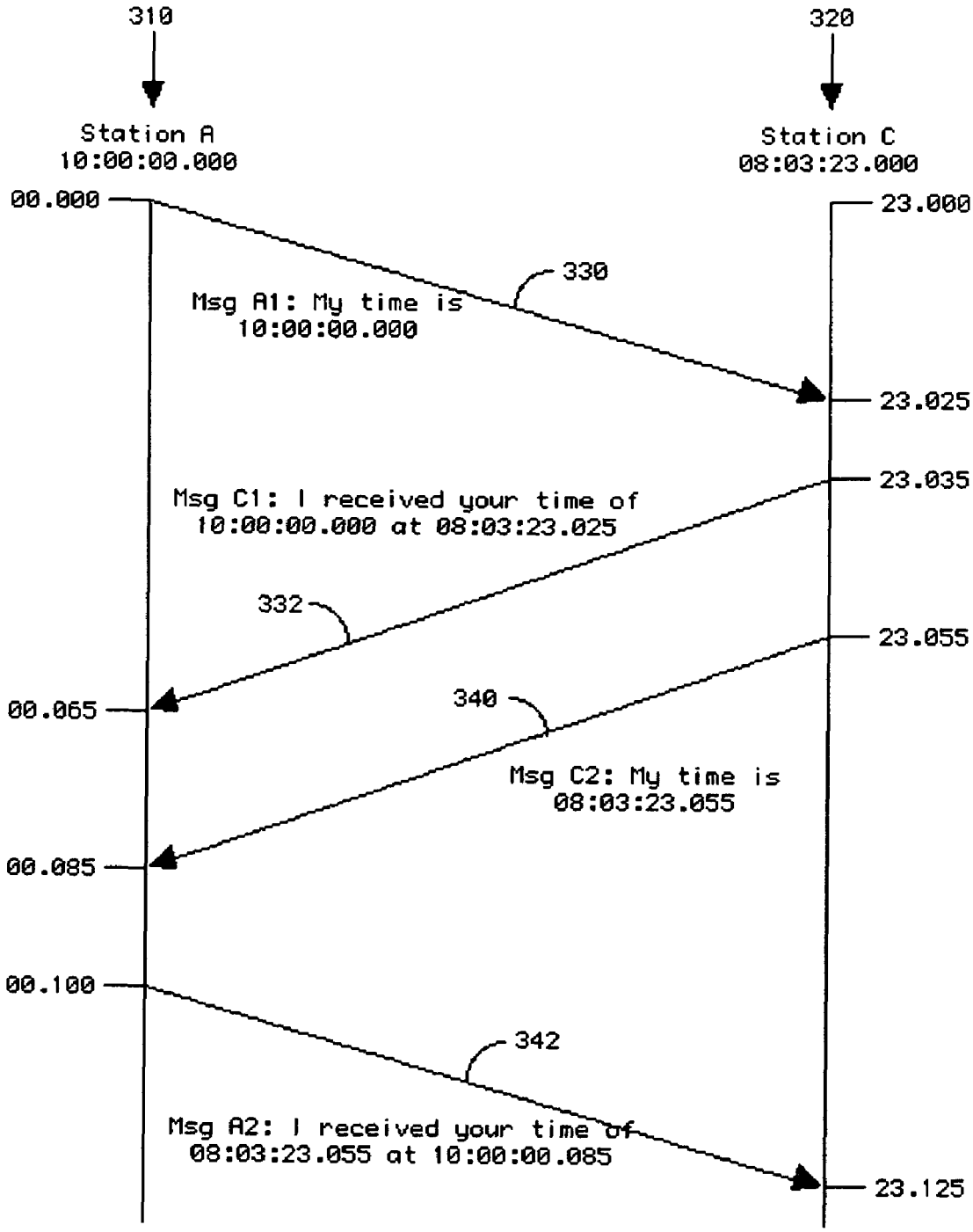
FIG. 3 is an example message exchange for synchronizing clocks between two stations of FIG. 2.

FIG. 3 illustrates a sequence of message exchanges between station A 210 and station C 230. Timeline 310 shows the timing of messages into and out of station A 210 according to the local clock of station A 210, the reference shared clock. Timeline 320 shows the timing of messages into and out of station C 230 according to the local clock of station C 230, from which station C needs to derive its shared clock so that it models the shared clock of station A.

At precisely 10:00 AM, station A 210 emits a message 330 to station C 230, announcing the time of the reference clock. The transport time across communication channel 150 from station A to C, interconnection 213, is 25 mS. Timeline 320 in the omniscient view of FIG. 3, shows that at the moment station A 210 emitted message 330, the local clock of station C 230 reads 08:03:23.000, or precisely 23.000 seconds after 8:03 AM. When message 330 arrives at station C 230, the 25 mS transport time across one-way interconnection 213 results in an arrival time of 08:03:23.025.

At this point, station C knows roughly that its local clock is two time zones behind that of station A, and about three minutes twenty-three seconds fast. But since neither station has omniscient knowledge about the latency of interconnection 213, an additional offset in the range of 0-200 mS, or possibly more, may be appropriate.

Station C logs this information, and sends a reply 332 to inform station A of the results. Reply 332 travels over interconnection 231. Station A now has the same information as station C.

Station C institutes a similar exchange. By sending message 340 to station A across interconnect 231, and receiving reply 342 over interconnect 213, stations A and C again share information.

Note that in this exchange, the precise timing of message 332 is not important. Alternative implementation can require that message 332 be sent immediately following receipt of message 330, whereby station A would discern a round-trip message timing directly. However, by tracking information on each interconnect separately, the probability of identifying a minimum, for each leg of a round trip is improved. Another alternative would be to combine the information of message 332 and 340 into a single transmission.

The exchange produces four time data: The time at which station A sent message 330 (tA1*s*), the time at which station C received message 330 (tA1*r*), the time at which station C sent message 340 (tC2*s*) and the time at which station A received message 340 (tC2*r*). Times tA1*s* and tC2*r* are relative to the local clock of station A, and times tA2*r* and tC2*s* are relative to the local clock of station C. In the following equations, dCA is the omniscient offset of the local clock of station C relative to the local clock of station A, in this case, 10:00:00.000-08:03:23.000, or 01:56:37.000, which is unknown. However, from the values measured and exchanged, the round trip time can be determined:

$$(tA1s-tA1r)=dCA-25\text{ mS},$$

$$(tC2r-tC2s)=dCA+30\text{ mS},$$

$$(tC2r-tC2s)-(tA1s-tA1r)=30\text{ mS}+25\text{ mS}=55\text{ mS}.$$

From the information in message 332, and knowing that the transport delay of interconnection 213 is in the range [0, 55 mS], a range can be derived for the difference dCA between the local clocks:

$$(tA1s - tA1r) = dCA - [0, 55\text{ mS}], \text{ or}$$

$$dCA = (tA1r - tA1s) + [0, 55\text{ mS}]$$

$$dCA = (10{:}00{:}00.000 - 08{:}03{:}23.025) + [0, 55\text{ mS}]$$

$$= 01{:}56{:}36.975 + [0, 55\text{ mS}]$$

$$= [01{:}56{:}36.975, 01{:}56{:}37.030]$$

The identical range is derived from the information in message 340:

$$(tC2r - tC2s) = dCA + [0, 55\text{ mS}], \text{ or}$$

$$dCA = (tC2r - tC2s) - [0, 55\text{ mS}]$$

$$dCA = (10{:}00{:}00.085 - 08{:}03{:}23.055) - [0, 55\text{ mS}]$$

$$= 01{:}56{:}37.030 - [0, 55\text{ mS}]$$

$$= [01{:}56{:}36.975, 01{:}56{:}37.030]$$

A reasonable estimate is to take the center of the range, which estimates that the two interconnections 213 and 231 are symmetrical, and allocate half of the round trip delay of 55 mS, or 27.5 mS, to each leg, resulting in an estimate that the clock of Station C is 01:56:37.0025 behind the local clock of Station A.

The 27.5 mS half round trip value is important: it represents the expected latency of musical events exchanged between stations A and C.

From this measurement alone, station C can now derive a shared clock referenced to the reference clock of station A.

However, in an implementation of communication channel 150 where transport delay is non-deterministic, the latencies of interconnections 213 and 231 will vary with each message sent. In such a case, a number of messages similar to 330, 332, 340, 342 may be exchanged. The results are not averaged, however, instead measurements resulting in the most restrictive range are combined. For instance, if a message pair (not shown) repeating an exchange similar to 330 and 332 were to encounter a spurious transport delay on interconnection 213 of 125 mS, the overall round trip estimate would be 155 mS, and the range of values for dCA would be a far less restrictive [01:56:36.875, 01:56:37.030]. In this case, the value for the bottom of the range for dCA could be disregarded, and the earlier, tighter value retained.

In the presence of accurate and stable local clocks, this algorithm is sufficient. However, where clocks are inaccurate (that is, they run fast or slow), or unstable (that is, whether and how fast or slow they run varies), the range for dCA obtained now will differ from the range obtained tomorrow. In fact, empirical experiments finds that mutual drift between the clocks of consumer grade personal computers can exceed 1 mS/minute (roughly the situation where one computer's clock gains almost a minute per day, and the other loses almost a minute per day). In the case of the example of FIGS. 2 and 3, this means that estimates of dCA taken an hour apart would result in mutually exclusive ranges.

To accommodate for this, the modeling of the reference clock performed by station C preferably includes a drift estimate. One method for estimating drift is to obtain a best measure (minimum round trip time) for one minute, and computer the center of the resulting range to obtain dCA1. A minute later, repeat the process to obtain dCA2. The difference between the two, divided by the interval between the measurements, represents the drift rate, which can now be incorporated into station C's model of the reference clock.

By this or similar methods, if granting shared clock 150 of station 10 the status of reference clock, each remote station 12 and 14 can create shared clocks 150' and 150" which models reference shared clock 150.

Allowably, any message being sent between any two stations contain a timestamp relative to the shared clock.

In alternative embodiments, each performance station 10, 12, 14 can maintain an estimate of the difference between its local system clock and the local system clocks of each other station. By this mechanism, any station can translate a timestamp relative to any local clock into a timestamp relative to any other local clock. The advantage of using a shared clock is that timestamps for exchanged and stored data are all relative to the same source.

As an implementation note, it is preferable that the first few rounds of the messages 330, 332, 340, 342 are ignored for the purpose of measurement. This is because the first time the routine to conduct the measurement is called, it will almost certainly not be in cache, and perhaps even be in swapped-out virtual memory, and therefor will run with an unusual, non-representative delay. Subsequent calls will operate much more efficiently. If the code is written in a language such as Java, and is running under a just-in-time (JIT) compiler, the first call to the routine may result in a compilation cycle, which will not subsequently be required. By ignoring the first few cycles of the communication channel delay measurement message, the measurements are more likely to be representative of the steady-state value for the communications delay between two stations. When communication channel 150 includes the Internet, additional first call delays can result as routers and firewalls evaluate paths and acceptability of newly forming interconnections.

A valuable side effect of message exchanges such as those of FIG. 3 is to allow each pair of performance stations to estimate the transport latency between them. A musician can use this information to inform selection of a local delay setting. Note that in an embodiment utilizing jam fanout server 18, the transport latency between two participating stations would be the sum of the latencies between each and the fanout server 18.

In the prior art as taught by Redmann, et al., when a musical event message is sent to delay 170, it is associated with a delay value. When the musical event message comes from the local event interpretation (e.g. 110 for performance station 10), then the delay value, called the Local Delay, was preferably set to the maximum of the half round trip values for communication with each of the other performance stations 12, 14. That is, local musical events from keyboard 100 are artificially delayed by delay 170 for the same amount of time that it takes for a message to arrive from the (temporally speaking) furthest participating performance station 12 or 14.

In the other case, when a musical event message comes from a remote performance station 12 or 14, then the delay value is calculated as the local delay less the value in that column for the transmitting station. That is, a remote musical event is preferably delayed artificially by delay 170 for enough additional time to equal the amount of time that it takes for a message to arrive from the (temporally speaking) furthest participating performance station.

In an implementation using shared clocks 150, 150', 150", at the moment keyboard 100, 100', 100" generates a musical event, event interpretation 110, 110', 110" applies a timestamp, all respectively. As the musical event is propagated to all delays 170, 170', and 170", the timestamp effectively embodies the prior art delay calculation. However, a substantial correction for variation in transport latency is provided, which is able to overcome the substantially inaccurate and unstable local clocks common to consumer grade computer equipment.

In the case where a remote musical event arrives at delay 170 with a timestamp whose value has already passed on shared clock 150, delay 170 may either immediately send the event to synthesizer 180, or it may drop the musical event without playing it.

In the case of a note-off or state altering events (e.g., change instrument), it is a preferable policy for the musical event to always be admitted. Blocking a note-off would result in a stuck-note situation, and blocking an instrument change message would result in the balance of the performance to be performed in the wrong voice.

However, in the case of a note-on, it is preferable for the musician operating station 10 to set a preference indicating his tolerance for these late events. This tolerance is preferably expressed as a time, as in notes arriving late, but within 20 mS of when they should be heard, are heard; but notes arriving more than 20 mS late are muted.

An alternative embodiment would be to express tolerance in musical terms, such as 1/32 note, or 3/64 notes. Depending on the tempo of the piece, typically expressed in beats (or quarter notes) per minute (BPM), the actually time represented by a late note tolerance of 1/32 note would vary. At 120 BPM, a 1/32 note translates to 62.5 mS, but if the tempo of the piece were to increase to 140 BPM, the tolerance would shrink to about 53.6 mS.

The result of delay 170 causing local musical events to be delayed before they are sent to the instrument synthesizer 180, is that the instrument takes on an additional quality of prolonged attack. That is, the time from when a musician presses a key to the time the instrument sounds is increased by the local delay value. For larger values of the local delay value, this can be perceptible to even a novice musician, e.g. a 1000 mS delay would result in the instrument sounding one full second after the key has been pressed. However, for smaller values of the delay, say, less than 100 mS, a novice musician is not terribly disturbed by the delay. Experienced musicians can adapt to delay values of 60 mS readily while no delay is desirable, an experienced musician can adapt to this new "property" of a musical instrument, and play "on top of" the beat to achieve a satisfying musical result.

In the prior art, Redmann et al. taught the use of a groove track, a predetermined audio file or MIDI sequence that is preferably possessed by each performance station 10, 12, and 14. The playback of a selected groove track was controlled by a play and stop button. The following discussion introduces the improvement of a distributed transport, comprised of shared clocks 115, 115', 115", local recorded channel storage 125, 125', 125", remote recorded channel storage 195, 195', 195", and the methods described below.

Preferably, the distributed transport operates in a manner that is substantially analogous to traditional magnetic tape recorders. Because the transport is physically distributed among the performance stations 10, 12, and 14, some deviation from a perfect analogy result.

Figure 4:
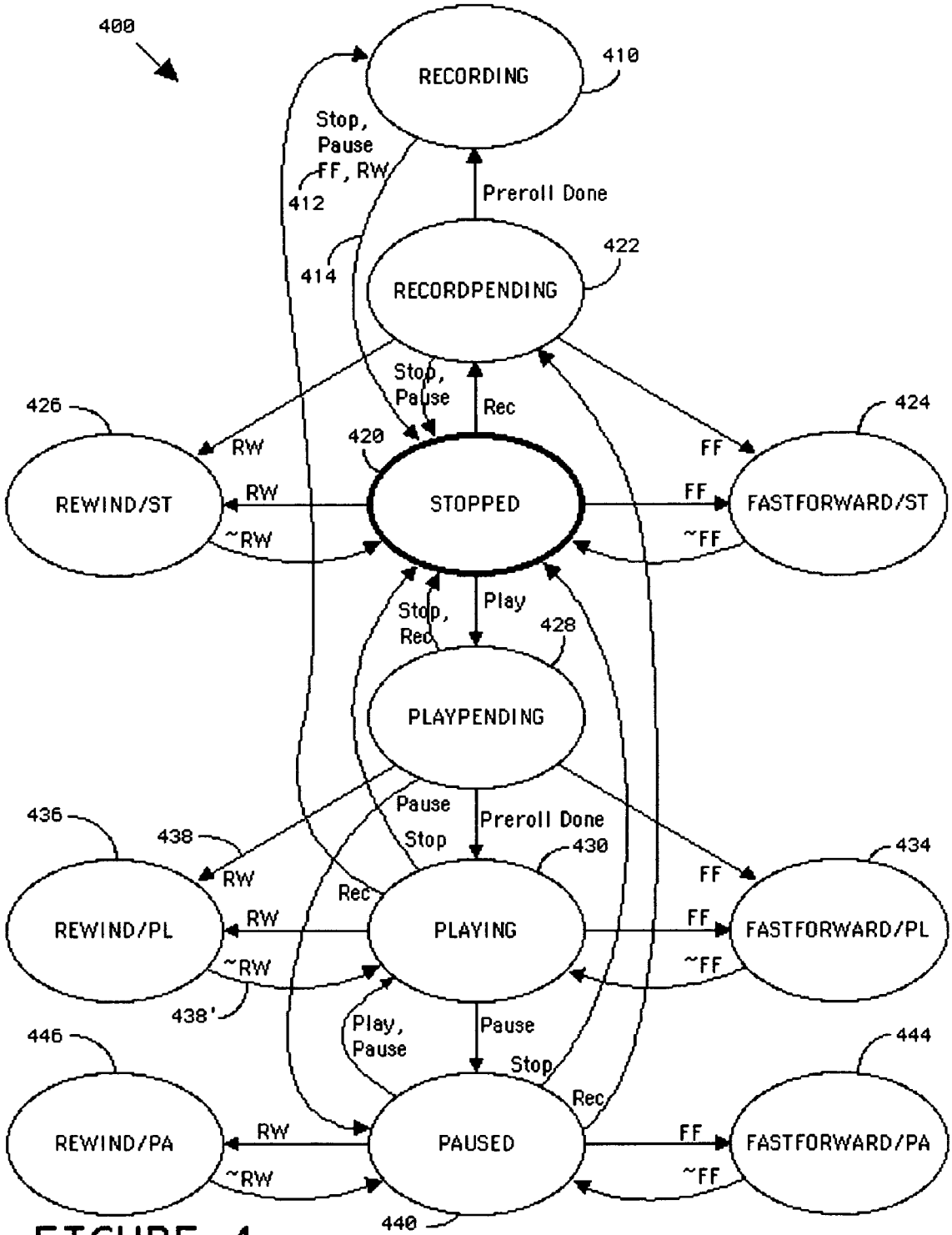
FIG. 4 is a state transition diagram for a distributed transport to record a musical collaboration.
Figure 5A:
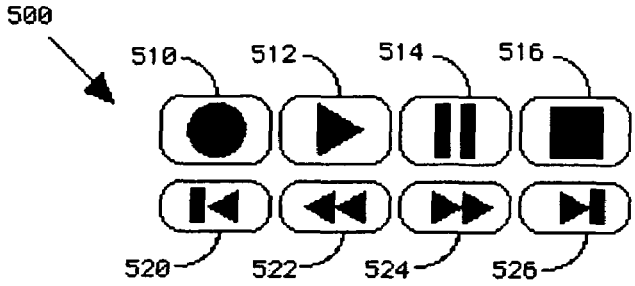
FIG. 5A depicts the controls for the distributed transport.

FIG. 4 shows distributed transport state machine 400 illustrating possible the states of distributed transport. Initially, the transport is in STOPPED state 420. FIG. 5A shows distributed transport controls 500. Actuation of any of the controls 500 may result in a change in transport state machine 400, described in more detail below.

Preferably, the controls 500 are each marked with well known icons for transport control, as shown with record button 510, play button 512, pause button 514, stop button 516, rewind button 522, and fast forward button 524. Additional controls jump-to-start button 520 and jump-to-end button 526 cause the transport to STOPPED state 420, and result in the stated transport position.

Figure 5B:
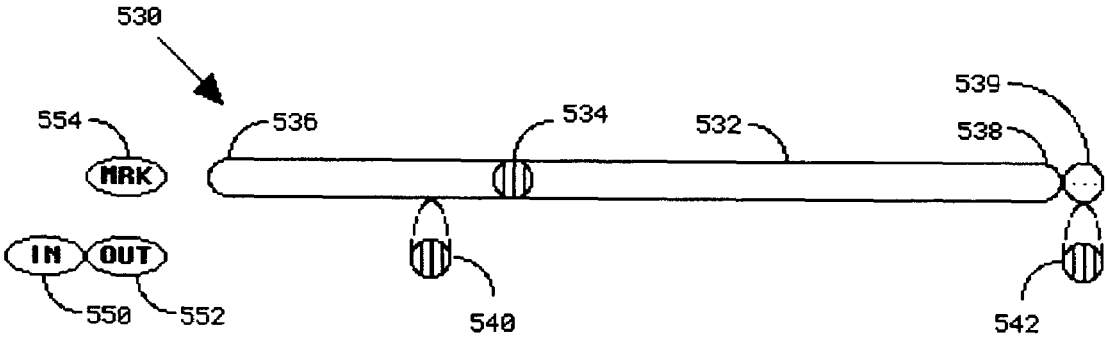
FIG. 5B depicts the controls for a timeline, as an alternate means for controlling some transport functions and depicting the transport position.

FIG. 5B shows one embodiment of a timeline display 530 able to indicate the position of the distributed transport and providing additional controls for its operation.

In the following discussion, the term song is used to represent a musical collaboration that is or is about to be recorded. It also includes the prior art notion of the groove track, insofar as a groove track may be loaded into the transport as the initial state of the song. For the purposes of discussion, each time transport state machine 400 progresses from STOPPED state 420 to RECORDING state 410 and back again, by whatever sequence of intermediate states, the song is said to possess an additional "take." For purposes of discussion, whether an initial groove track is loaded as the initial state of the song, or whether the song is empty, this will be referred to as Take 0. The next time the transport enters the RECORDING state 410 will result in Take 1. However, any consistent naming convention would suffice.

The timeline 532 represents the entirety of a song, regardless of its length, including if the song is empty (zero length) at Take 0.

Thumb 534 travels along timeline 532, and represents the current position of the transport within the song. Start point 536 and end point 538 represent the beginning and ending times of the song, while special point 539 bears an ellipsis icon " . . . " and represents "past the end" of the song.

Initially, presuming a groove track is loaded, the distributed transport would be stopped, and thumb 534 would be at start point 536, indicating that the transport is at the beginning of the song.

While it is technically possible for transport controls 500 and timeline controls 530 to be accessible to each of the musicians operating performance stations 10, 12, 14, it is strongly preferred that a single one of them be designated to exercise sole control over the transport. This is strictly a sociological limitation aimed at reducing confusion and crossed expectations that would lead to chaos. For the purposes of discussion, the musician so designated is referred to as the engineer, alluding to the recording studio role of the transport operator. In the description that follows, the preferred embodiment wherein the engineer controls the transport is presented.

The thumb 534 of the timeline can be dragged to any position in the song, from start 536 to end 538. Punch-in point slider 540 and punch-out point slider 542 can each be moved to any point on the timeline, from start 526 to end 538, provided that the punch-out point slider 542 remain to the right of punch-in point slider 540. Additionally, punch-out point slider can be positioned at special point 539, past the end of the song. Marker button 554 allows a named marker to be created corresponding to the current position of the thumb 534, that is, the current position in the song. This is convenient for defining positions in the song with descriptions like "Verse 2" or "Bridge." Alternatively, the dialog summoned by marker button 554 can offer the creation of markers at positions defined numerically. Set IN button 550 and Set OUT button 552 allow setting the corresponding punch-in 540 or punch-out point slider 542, respectively, to one of previously established markers. When punch-in 540 is set to other than start 536 or punch-out 542 is set to other than the special point 539, pressing record button 510 causes the transport to rewind to the song position designated by the punch-in point slider 540 (less any preroll), and record until the transport reaches the punch-out point slider 542, or until the stop button 516 is pressed. The behavior of this timeline control is well known, and presented merely for the sake of completeness. Many alternative behaviors of timelines, transports, and punch-in/punch-out markers are seen in a broad variety of modern sequencer software, and will be quite familiar to those knowledgeable in the field.

With a position in the song designated by the thumb 534, the engineer presses play button 512, resulting in the distributed transport advancing to PLAYPENDING state 428. This intermediate state allows for reliable propagation of the command to all performance stations. Essentially, a message is composed by the engineer's performance station: a future time, X, at which playback will start is computed relative to the shared clock, i.e. the current time on the shared clock plus two seconds. The message transferred to each remote station may be expressed as "at time X begin playback at song position 0". The two-second offset is merely exemplary of a short time, but one sufficient for ensuring that the message is transferred and acknowledged by all remote stations. A preroll or countdown to the playback may be optionally included. At time X on shared clock 115, 115', 115", the distributed transport will transition to the PLAYING state 430 and each performance station 10, 12, 14 respectively will begin playback of the song.

In distributed transport state machine 400, the transitions from one state to another are labeled with tags indicating which of controls 500 result in the transition (except 520 and 526). For instance, transition 438 from PLAYPENDING 428 to REWIND/PL 436 is labeled with RW, representing rewind button 522. Transition 438 is labeled with ~RW, indicating that the transition occurs on the release of rewind button 522. When the transport state machine 400 indicates that the current state of the distributed transport does not have an outbound transitions corresponding to a particular one of the transport controls 500, then that particular control is considered to be disabled. For instance, REWIND/ST state 426 can be reached from STOPPED state 420, by pressing rewind (RW) button 522. STOPPED state 420 would also have recognized presses of fast forward (FF) button 524, record (Rec) button 510, and play button 512. However, once REWIND/ST state 426 has been entered, the only control action that can exit that state is the release (~RW) of the rewind button 522, whereupon the transport returns to STOPPED state 420.

Note that when the state of the distributed transport is PLAYPENDING 428 or PLAYING 430, the fast forward 524 and rewind 522 buttons engage the FASTFORWARD/PL 434 and REWIND/PL 436 states which ultimately return to PLAYING state 430. A similar relationship exists among the STOPPED 420 or RECORDEDPENDING 422 states, and the FASTFORWARD/ST 424 and REWIND/ST 426 states returning to STEPPED state 420. The FASTFORWARD/PA 444 and REWIND/PA 446 states return to the PAUSED state 440. However all rewind states 426, 436, 446 and all fast forward states 424, 434, 444 share a common property, that is they rapidly move the current position of the distributed transport backward or forward respectively in the song. This movement would be reflected in real time by song position thumb 534.

While in PLAYING state 430, pressing pause button 514 would result in a transition to PAUSED state 440. Since the implementation of the transport at the engineer's performance station can react more quickly than those at remote stations, the message propagated for the distributed transport needs to be "move to song position Y and stop". This ensures that even if one performance station played a note or two more or less than another due to race conditions, all the performance stations reflect the same status when in steady state. The primary purpose of PLAYPENDING 428 and RECORDPENDING 422 states is to allow all stations to reach steady state and ensure synchrony before musical performance begins.

In case of leaving the REWIND/ST state 426, or FASTFORWARD/ST state 424 to the STOPPED state 420 where the transport is at song position Y and will not be running, the message sent to the remote stations would be "move to song position Y and stop". A similar message is constructed upon transition to PAUSED 440 from states 444 or 446. However upon transition to PLAYING state 430 from states 434 or 436, the message would need to include a target time, as before: "at time X begin playback at song position Y."

Recording represents the most critical of the distributed transport functions. The transition into and out of the RECORDING state 410 and the timings thereof determine which musical events from each of the performance stations is ultimate captured into a permanent record.

Upon pressing record. (Rec) button 510 from STOPPED state 420, the engineer's station issues the message "at time X begin recording at song position Y with preroll of two measures", where X is the RECORD_START time, some amount of time in the future, for the same reasons as described above with the playback message. Upon receipt of this message, each performance station 10, 12, 14 begins capturing events performed locally into local recorded channel storage 125, 125', 125" respectively. Each musical event, when played is locally timestamped with the value of the current shared clock 115, 115', 115", plus each's local delay. Preferably, events with a timestamp before X are discarded, although an alternative implementation would be to allow events up to a beat or so (a value set by a preference) in advance of X, to be captured.

Preferably, the message that initiates recording can be of the form "at time X begin recording at song position Y with preroll of two measures". The preroll phrase allows the engineer to specify as a matter of preference that a certain number of beats will be played prior to recording beginning. This allows participating musicians to get a feel for the beat, rather than having to start immediately as the transport begins to record. In the alternative, the musicians can merely agree to follow the lead of the drummer, or the beat of the groove track, and begin when appropriate.

While in the RECORD state 410, all musical events are distributed among the connected performance stations 10, 12, 14. Upon receipt, remote musical events are advanced as described above through communication channel interface 140, receiver module 160, and held in delay 170 until they are to be played or (if too late) discarded.

When stop button 516 (or alternative buttons as indicated by group transition events 412) is pressed, a stop message is generated of the form "at time X, stop recording," where X is the RECORD_STOP time. It is not so critical that the stop message be received synchronously, since any extra data captured following the RECORD_STOP time will be trimmed in subsequently processing, described in conjunction with FIG. 6.

At this time, it is useful to discuss channels in the distributed musical collaboration. In order to facilitate each musician's performance being captured independently of the others', it is valuable to maintain each musician one or more channels distinct from those used by the others. The sixteen channels inherent in MIDI data is a mechanism well suited to this need, and is commonly employed for this purpose. Alternatively, a more elaborate mechanism can be employed to obtain a number of channels far in excess of sixteen, for instance, in MIDI sequencer software channels are frequently assigned a MIDI port as well as a MIDI channel, resulting in a channel count up to 16 times the number of ports. Other methods of obtaining more channels will occur to those skilled in the art.

Figure 5C:
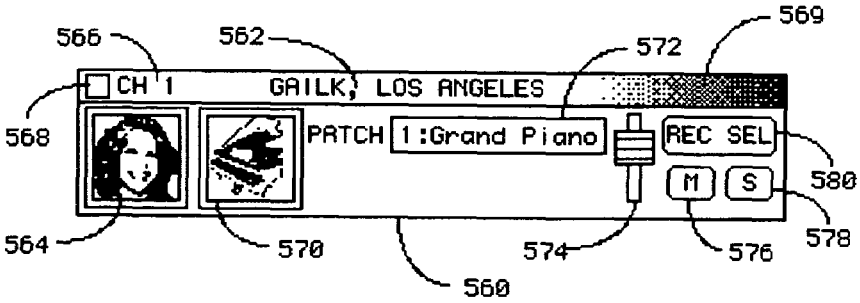
FIG. 5C depicts the controls for a single channel of the musical collaboration.

FIG. 5C illustrates one embodiment of a musician's channel control 560. Preferably one channel control 560 is provided for each channel assigned to each musician. A channel control is in most ways analogous to a channel on a studio mixing board or in sequencing or audio mixing software. However, because these controls operate in a distributed environment, channel control 560 includes some non-analogous elements.

Each channel control 560 is assigned to zero or one musician, whose name is 562 indicates the assignment. Channel controls without a musician assigned may be blank, or may represent the groove. Such channel assignments would be suitably indicated (not shown). Preferably, the physical location of the owning musician is shown in conjunction with name 562. Also, an icon 564, which may be a photograph, may represent the musician, too.

The instrument that the assigned musician is intending for each channel is shown as an icon 570 and name 572. Preferably, instrument icon 570 relates to the family of instrument, and a text display of the instrument name 572 corresponds to a specific one of the one hundred twenty-seven officially designated instruments defined by the General MIDI Specification, published by the MIDI Manufacturers Association. Adherence to the General MIDI (GM) Specification greatly accelerates the process of one musician conforming to another's instrument selection. However, if one musician doesn't have instrument synthesizer 180 that conforms to the General MIDI Specification, then the instrument family and text description will suggest a sense of what instrument is intended by the musician to whom the channel is assigned. An alternative embodiment, not shown, also permits a more specific patch designation. In conjunction with the instrument name 572, a description of the exact patch (not shown) may be provided. This allows another musician who owns identical equipment to match the patch exactly, or in the alternative, to find other sophisticated patches that better resemble the nuance of the selected instrument than does the default GM patch. However, even in the presence of a more sophisticated patch, the designation of GM patch is a convenient shortcut for identifying the kind of instrument intended. In addition, the GM patch designation 572 lends itself to automation, where when a performance station receives a musical event indicating a GM patch change, GM-compatible equipment will automatically change the instrument. If a non-GM patch change is sent (or a non-GM compatible instrument synthesizer 180 is used), the display may update, but the instrument will need to be manually adjusted to conform to the assigned musician's intent.

Each channel control 560 operates on a particular MIDI output channel, as shown by output channel indicator 566. Preferably, each channel is assigned to the same MIDI output channel globally, that is GAILK's (from name 562) Grand Piano (from instrument name 572) is on MIDI output channel 1 (from indicator 566).

If GAILK is a remote musician, then remote musical events on this channel are received, and if timely (i.e. not beyond the local late note tolerance), played on MIDI output channel 1. When a MIDI note is played, MIDI activity indicator 568 should flash. If the musical event is too late to be played, the late note indicator 569 will flash, instead. Preferably, if a note is late, but within the local late note tolerance, late note indicator 569 will flash, but with a different color or intensity. For example, for slightly late notes, indicator 569 will blink yellow, but for notes so late as to be muted it will blink red.

If GAILK is the local musician, then indicator 569 will never flash (local musical events are never late). MIDI indicator 568 represent activity on the MIDI input channel assigned to this instrument. While the channel designator 566 preferably represents a global channel assignment to a MIDI output channels, the MIDI input channels assignments are not global. Typically, each musician will have a single MIDI controller, and probably each will be on MIDI input channel 1. It is a function of event interpreter 110 to map from the local musician's MIDI input channel to the assigned MIDI output channel. Most MIDI controllers can be assigned to any of the sixteen MIDI channels. In the case of a musician only having a single MIDI controller, it doesn't have to matter what MIDI input channel is in use, the event interpreter 110 can take all MIDI input, regardless of channel (well known as OMNI mode), and move it to the assigned MIDI output channel. In the case where a musician has more than one MIDI controller, each will need to be assigned a separate MIDI input channel, and event interpreter 110 will need to map each MIDI input channel to an assigned MIDI output channel. In this situation, MIDI activity indicator 568 may show a MIDI input channel designation (not shown) in the form of a MIDI input channel number from one to sixteen.

Each channel further has a monitor level control 574 to adjust the volume at which each channel is heard locally. This local control allows each musician to control how much of the other instruments is heard locally. For instance, if a musician is attempting to follow a bass line, the monitor for that channel might be pushed up. Note that monitor 574 preferably has no effect on the level at which a channel is recorded. In order to quickly silence a channel locally, mute button 576 is provided. The solo button 576 allows a musician to listen exclusively to the soloed instrument, as if all other channels had been muted.

The record selected button 580 is a local control that interacts strongly with the transport moving into and out of RECORDING state 310. Preferably, a channel is only recorded while the transport is in RECORDING state 310 and the record select button 580 is selected. For a musician having multiple instruments, it allows control over which instrument is recording presently. For a musician electing to "sit out" for a take (not alter the prior recording), leaving record select 580 unselected prevents his non-playing of the instrument to effectively erase previous recordings. Further, a sophisticated musician may elect to "punch-in" while the transport is recording, by activating record select button 580, thereby effecting a RECORD_START unique to that channel. The musician can "punch-out", effecting a RECORD_STOP to cease recording on that channel, even though the transport is still in the RECORDING state 310 and still recording on other channels. Subsequently, the musician can punch-in and -out on that or other channels. In so doing, a musician can record one or more discrete intervals on a single channel during a single take.

During the RECORDING state 310, a groove track on channels not assigned to performing musicians will playback in synch with the recording process. Previously recorded performances on channels currently assigned to musicians, will playback also, unless record select 580 is selected, in which case the live performance on that channel is heard and recorded. Upon conclusion of the take, when the stop button 516 is pressed, a merging process occurs, illustrated in FIG. 6. If a musician would prefer to not hear playback of one or more channels, including the groove track, the mute button 576 corresponding to the unwanted channel can be activated.

Figure 6:
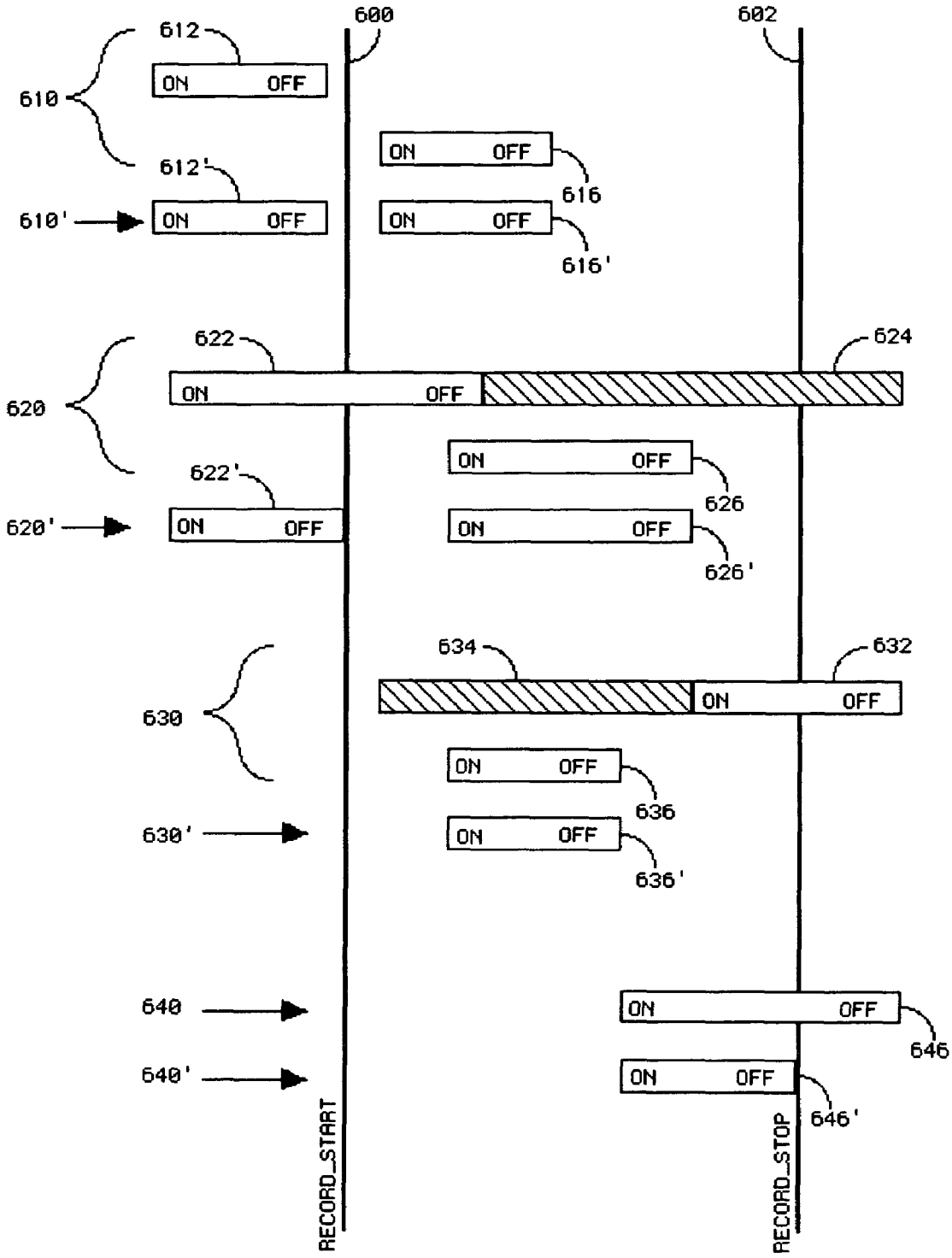
FIG. 6 shows previously recorded and current musical events are cropped and edited responsive to record commands.

FIG. 6 depicts musical events occurring in temporal proximity to the RECORD_START time 600 and RECORD_STOP time 602 of a single interval. Such an interval usually spans an entire take, from the entry to the RECORDING state 310 to exit from it. However, as discussed above, an interval can be shortened for an individual channel with the use of the record select button 580. Musical event groups 610, 620, 630, and 640 represent previous musical events 612, 622, 632, (there is no 642) from an earlier take and current musical events 616, 626, 636, 646 from the current take, all respectively. Composite musical event groups 610', 620', 630', and 640' comprised of musical events 612', 616', 622', 626', (there is no 632'), 636', and 646', each corresponding to their like-numbered counterpart. Each musical event group corresponds to musical events happening on a distinct channel. Whether the channel is assigned to a local or remote musician is essentially moot, except that this editing of channel data preferably takes place on the local performance station. The result is the same, regardless.

In the discussion that immediately follows, the separate MIDI commands of note-on and note-off are paired and the resulting performance of a note and its duration are manipulated as an individual musical event.

In the example of musical event group 610, previously recorded musical event 612 begins and ends prior to RECORD_START 600, while newly recorded event 616 begins and ends entirely between RECORD_START 600 and RECORD_STOP 602. In direct analogy to the behavior of a magnetic tape recording, where everything that was on the tape prior to RECORD_START 600 remains unaltered, everything that occurred during the current take between RECORD_START 600 and RECORD_STOP 602 (including silence) overwrites anything that pre-existed on the tape (which in this case was nothing). Everything after RECORD_STOP 602 is unaltered. The resulting composite musical event group 610' contains copy 612' of pre-existing event 612, and copy 616' of event 616 from the current take.

In musical event group 620, a different situation is shown. The pair of MIDI commands forming musical event 622 spans RECORD_START 600. Potentially, it could span RECORD_STOP 602 too, as shown by event segment 624. With or without the additional duration of event segment 624, the same truncated copy 622' preferably results in. This represents the audio magnetic tape analog of pre-recorded music on the tape where the new take recording is to start. In the analogy, a previously recorded sound is cut off at RECORD_START 600, and through RECORD_STOP 602, only music played during that interval will survive. This is modeled by truncated copy 622': while the beginning of musical event 622 is reflected in copy 622', the actual end of musical event 622 (even if including the extension 624) is disregarded and instead copy 622'is forced to terminate at RECORD_START 600. As before, current musical event 626 is copied into the resulting take 620' as 626'.

In musical event group 630, previous musical event 632 (with or without extension 634) begins between the RECORD_START 600 and RECORD_STOP 602. As a result, it is preferably omitted completely from the resulting take 630', that is, there is no copy of event 632 in 630'. As before, current musical event 636 is copied into the resulting take 630' as 636'.

Musical event group 640 comprises only current musical event 646, which begins within the recording interval, but extends beyond RECORD_STOP 602. Preferably, a musical event is constrained to fall within the recording interval, and so copy 646' of current musical event 646 is truncated so that it ends at RECORD_STOP 602.

While not separately illustrated, were any current musical events to begin before RECORD_START 600, they would preferably be completely excluded from the resulting take. That is, if event 622 (with or without extension 624) were a current event, rather than a previous musical event, then there would be no 622' in the resulting take 620'.

The above rules for editing and combining current musical events with previous musical events represent one embodiment. An alternative embodiment might not mix a previous take with the next, and could instead retain each take alone.

Other alternative implementations could change individual rules, such as not truncating events at the RECORD_STOP 602 point, so that copied event 646' would be the same length as 646.

Figure 7:
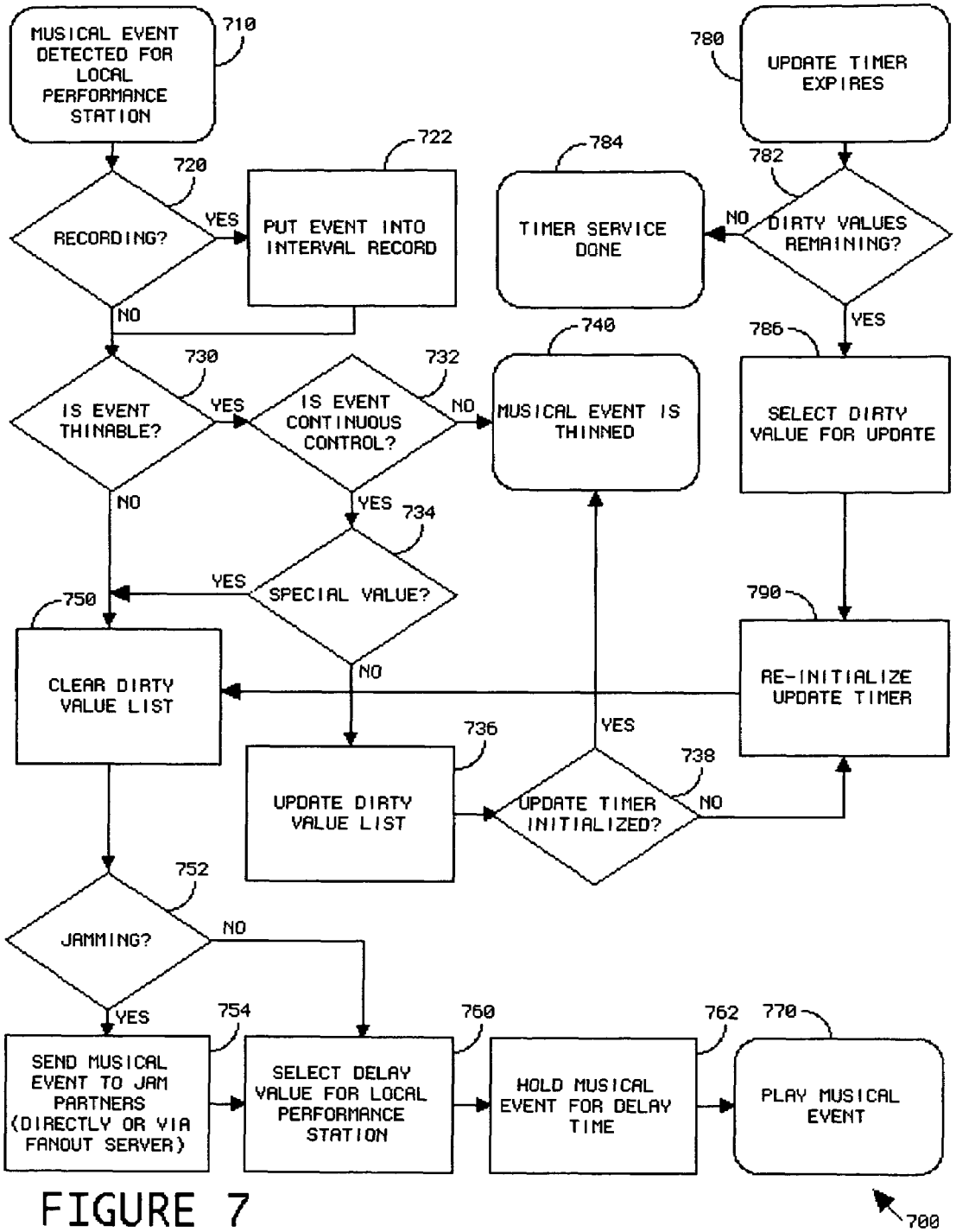
FIG. 7 is a flowchart describing a live collaboration process to record and improve a distributed musical collaboration.

FIG. 7 shows the preferred live collaboration process 700 to allow recording and improved live performance.

In step 710, a musical event is detected for the local performance station, typically by event interpretation 110. The current value of shared clock 115 is added to the local delay value, and the result is used as a timestamp for musical event . . . it represents the point in the future at which the current musical event is to occur.

In step 720, an evaluation is made whether the performance station is in RECORDING mode 410. If not, step 722 is bypassed, otherwise step 722 is performed.

The local musical event is recorded into local recorded event storage 125 in step 722. While the timestamp may remain referenced to the shared clock timebase, it is preferably stored in a timebase relative to the beginning of the song. This translation preferably occurs on entry to storage 125, but may occur in step 710, or elsewhere. An alternative implementation would retain the timestamps relative to the shared clock, and maintain translation data to permit conversion to song-relative time at need. In a still different embodiment, the timestamp can be stored in a delta-time form where instead of a timestamp, the time elapsed since the prior recorded event is stored. This latter embodiment will be familiar to those skilled in the art, since it is the manner in which timing information is stored in a standard MIDI file).

Subsequently, the musical event is evaluated in step 730 by event interpreter 110 as to whether it may be thinned, or not.

Certain musical events are critical to a performance and may not be thinned, while other musical events represent nuance of a performance that, while valuable, is not absolutely essential and may reasonably be thinned if the alternative were to disrupt or discontinue the remote collaboration.

A MIDI instrument performance having lots of after-touch, pitch-bend, or other continuous controller nuance can generate enough MIDI data to fill a single MIDI cable. Classically, a MIDI-OUT used a 19.2 kbaud serial port, which represents far less bandwidth than typically available with communication channel 150. However, a significant overhead can be introduced by IP, UDP, or other protocol headers. This is multiplied by the fanout of the jam: To how many other remote performance stations must each musical event be sent? Further, modern MIDI-IN ports may use a USB or other higher-speed interface. As a result, circumstances can easily exist where the bandwidth of the local MIDI performance exceeds the bandwidth of one or more of the communication channel interfaces 140, 140', 140".

As an example, suppose the communication channel interface 140 of performance station 10 is a DSL modem having an uplink bandwidth of 128K baud to the communication channel 150, the Internet. This represents a byte rate of about 12,800 bytes per second. In a collaboration of five musicians, four would be remote from performance station 10, resulting in the uplink bandwidth being split four ways, or 3,200 byte per second each. If the average MIDI message length is 4 bytes and is placed into an individual packet, the addition overhead for that packet to be transported over the modem is eight bytes for the Point-to-Point Protocol (PPP), twenty bytes for the Internet Protocol (IP), and eight more for the User Datagram Protocol (UDP), for a total packet size of 40 bytes per MIDI message. This limits the outbound MIDI event rate to about 80 musical events per second. Suppose performance station 10 has a piano keyboard MIDI controller as keyboard 100, further suppose that the musical tempo is a very typical 120 beats per minute, in 4/4 time, which represents a quarter note every half second. Suppose the local musician repeatedly plays a single chord in eighth notes. Four times per second, the striking of the chord generates note-on messages, and four times per second the releasing of the chord generates note-off messages. Eighty musical events per second, divided by four (eighth notes are a quarter second interval in this example), divided by two again (for the separate note-on and note-off events), is merely ten notes per chord . . . just enough for the musician to use all ten fingers in this performance.

This example suggests that a severe limitation would result when using the Internet with a dial-up modem, which would typically be limited to 56K baud. By the same reasoning, a faster DSL connection or cable modem would provide significantly less restriction. Even at higher bandwidths, however, a musical performance can contain far more information than just when notes turn on and off.

The nuance in a performance can be expressed in messages such as pitchbend, aftertouch, and other continuous controller messages. While commands such as NOTE-ON and NOTE-OFF are examples of commands that should be ensured a place in the stream, while PITCHBEND or AFTERTOUCH commands can be sent on a "space available" basis.

For such optional commands, it is frequently the case that the most recent of them is more valuable than more aged versions. For instance, if three pitchbend commands have been queued for transmission, but room is available for only one to be sent, then it should be the most recent. Further, if there is presently room for none of the three pitchbend commands, then the last of these should be retained for sending in the future, should more space open up. That way, a long-term setting is transmitted, even if its onset is not precisely correct.

In addition, it may be desirable for certain values to be considered "special", for instance, a pitchbend of zero might, in general, have particular weight.

Step 730, therefore, evaluates the musical event. If it is critical to the performance and cannot be thinned, processing continues at step 750. If thinning is allowed for the musical event, processing continues at step 732.

The event is examined in step 732 to discern whether it is a continuous control event, such as a pitchbend or aftertouch.

If the event is not a continuous control, it is immediately dropped in step 740 and will not be sent to any performance station, including the local one. In an alternative embodiment, the event does continue to be processed by the local performance station 10, and the thinning only applies to remote stations.

If the event is a continuous control, it is examined in step 734 to determine whether it is a special value. A simple determination may be whether the current value is zero. More sophisticated criteria may be applied, for instance whether the current value represents significant deviation or extreme value, relative to the previous value or recent performance. If the continuous controller value does qualify as special and ought not to be thinned, processing continues with step 750. Otherwise, processing continues with step 736.

The stream of values represented by multiple continuous control value update events may be thought of as a slowly varying waveform. For example, if a musician is producing a warbling effect by wiggling the pitchwheel of keyboard 100, then the series of pitchbend values generated by the MIDI controller could be graphed to reveal a sinusoidal path whose time varying amplitude and period correspond to the musician's movements of the pitchwheel. However, even though the musician's manipulations of the pitchwheel were physically smooth, continuous movements, the discrete, digital nature of MIDI messages limits the expression of those continuous movements to a sequence of measurements sampled in time. In a situation where these samples are too numerous and cannot all be used, a newer controller value is more valuable than an older controller value.

In step 736, the controller value in the current musical event is noted as the most recent for the corresponding controller. Further, the corresponding controller value is noted as DIRTY, that is, the noted value is the most recent, but the value is unsent.

One any value has been entered into the dirty list, step 738 determines whether throttling is in effect. One way to implement throttling is to maintain a hold-off timer that ensures no two controller updates are sent within a predetermined interval. Step 738 can examine the timer to determine if an unexpired interval is pending. If so, the current musical event is discarded in step 740. However, if no hold-off interval is currently in effect, the hold-off time is re-initialized to a predetermined value (e.g. 5 or 10 mS) and rather than being discarded, the processing of the current musical event continues in step 750.

In step 750, the current musical event is examined versus the current dirty value list accumulated by executions of step 736. If the current musical event corresponds with any event tracked in the dirty value list, that value is updated to the value appearing in the current musical event, and the entry is marked as CLEAN, that is, the noted value is both the most recent, and has been sent.

In step 752, a determination is made whether this even is to be sent to other performance stations. If so, this is done in step 754, corresponding to the event being passed to event formatting 120. The current musical event is then passed in step 760 to delay 170, were it undergoes a waiting period 762 for the duration of the local delay. Once the local delay time has elapsed, the musical event is passed in step 770 to instrument synthesizer 180 to be sounded.

When more than one controller updates were attempted within the predetermined interval, the latter event is thinned by the decision at step 738. This ensures that if the dirty list accumulated by step 736 contains any DIRTY values, then the hold-off timer is running. When the running hold-off timer counts out the predetermined interval, the update timer expires, in step 780.

A scan of the dirty list in step 782 determines if there are any dirty values left to be updated. If not, processing of the dirty list halts in step 784. Otherwise, the next dirty value in the list is selected in step 786 and a musical event is constructed to update the selected dirty value on the performance stations. By virtue of prior executions of step 750, this is assured to be the most recent value for the continuous controller being updated. Before processing of the constructed musical event continues, the hold-off timer is re-initialized in step 790, after which processing of the constructed musical event proceeds in step 750, as if the constructed musical event were a normal, locally generated musical event.

Those skilled in the art will recognize that steps 710 and 780 represent entry points into a process having critical regions which may require mutually exclusive access, especially steps 736, 750, and 786. Resolving such concerns is well within the abilities of those of ordinary skill in the art, and only requires this mention.

In the preferred embodiment of step 786, the dirty list is simply scanned circularly. Once a dirty value is selected to be updated, the next execution of step 786 will resume the scan where just after where it last stopped. This gives all values in the dirty list an equal opportunity. Other algorithms can be employed: One alternative embodiment would select the least-recently updated control in the dirty list; or channel controls (such as pitchbend) might be given a higher priority than note controls (such as aftertouch). A more complex embodiment maintains multiple dirty lists of differing priorities.

In yet another embodiment, each prioritized dirty list has a separate timer, with higher priority lists having shorter predetermined intervals.

In an alternative embodiment of live collaboration process 700, the hold-off interval can be determined by recent musical event arrival rates, or communication channel interface traffic: if the communication channel interface 140 buffer registers as getting full, the throttling of initiated in step 738 is increased by increasing the hold-off interval. As the buffer empties, the hold-off interval can be decreased. This implementation has the advantage of providing higher fidelity when traffic is light (not counting thinable events), but maintaining low latency for critical musical events when traffic is heavy.

A more complex embodiment of step 754, particularly valuable when communication channel 150 is the Internet and has the packet overhead discussed above, accumulates multiple musical events and transports them in a single packet. Format for jam partners 120 can implement this step. As long as the transmit buffer of transmitter 130 is non-empty, formatter 120 can continue to gather events for each remote performance station. As the transmit buffer of transmitter 130 empties, the oldest musical event and all other musical events destined for the same performance station is formatted and passed to the transmitter 130. For UDP/IP/PPP packets, this can represent a significant reduction in protocol overhead, which exceeds 400% for simple MIDI messages such as note-on.

Within the MIDI specification, a class of message designated "System Exclusive" (SYSEX) is reserved for definition by individual manufacturers to implement data exchanges which may be appropriate only to specific models of MIDI devices. Therefore, it can be the case that a SYSEX musical event generated on the local performance station 10 may have no value at all to the remote performance stations 12 and 14. In the above embodiment, step 730 would consider a SYSEX message to be thinable, and it would normally proceed through step 732 and be discarded in step 740. However, if performance station 12 had equipment or software responsive to the SYSEX musical event, it may be valuable to send that SYSEX message to station 12, but not station 14. If each channel control 560 has a more specific patch designation (not shown) as discussed above in reference to patch description 572, and such a patch is designated at both the local performance station 10 and one or more of the remote performance stations for the same MIDI-OUT channel 566, then an alternative embodiment of step 730 would permit the SYSEX message to pass. An alternative implementation of step 754 would preferably send the SYSEX message only to those remote performance stations having the same more specific patch designation (not shown) on the same MIDI-OUT channel 566.

Step 750 preferably maintains a note-on list (not shown), keeping track of which notes are on, on which channels. When step 750 detects that a channel should be silent, that is, zero notes are listed as currently playing on a channel because all have been cancelled by a corresponding note-off command, then the step 750 can initiate an All Notes Off command for the indicated channel. This may be achieved by replacing the note-off message of the current musical event with the All Notes Off message. But preferably, a flag is set and an interval timer (not shown) periodically examines the flags for all channels to determine which, if any, might receive an All Notes Off message. The value of the All Notes Off message comes is apparent when the communication channel 150 is lossy, and a note-off message is inadvertently dropped, resulting in a stuck note. If the station to which the channel is assigned periodically indicates that the channel should be silent, stuck notes may be terminated before they become too annoying.

In another embodiment, the local notes-on list is occasionally transmitted to remote performance stations. Any note at a remote station that is playing, but not found in the notes-on list, can be terminated with a note-off message generated at the remote performance station to replace the note-off message that was presumably lost. Asymmetrically, it would not be appropriate to generate a note-on message to replace one that appeared to have been lost.

Figure 8:
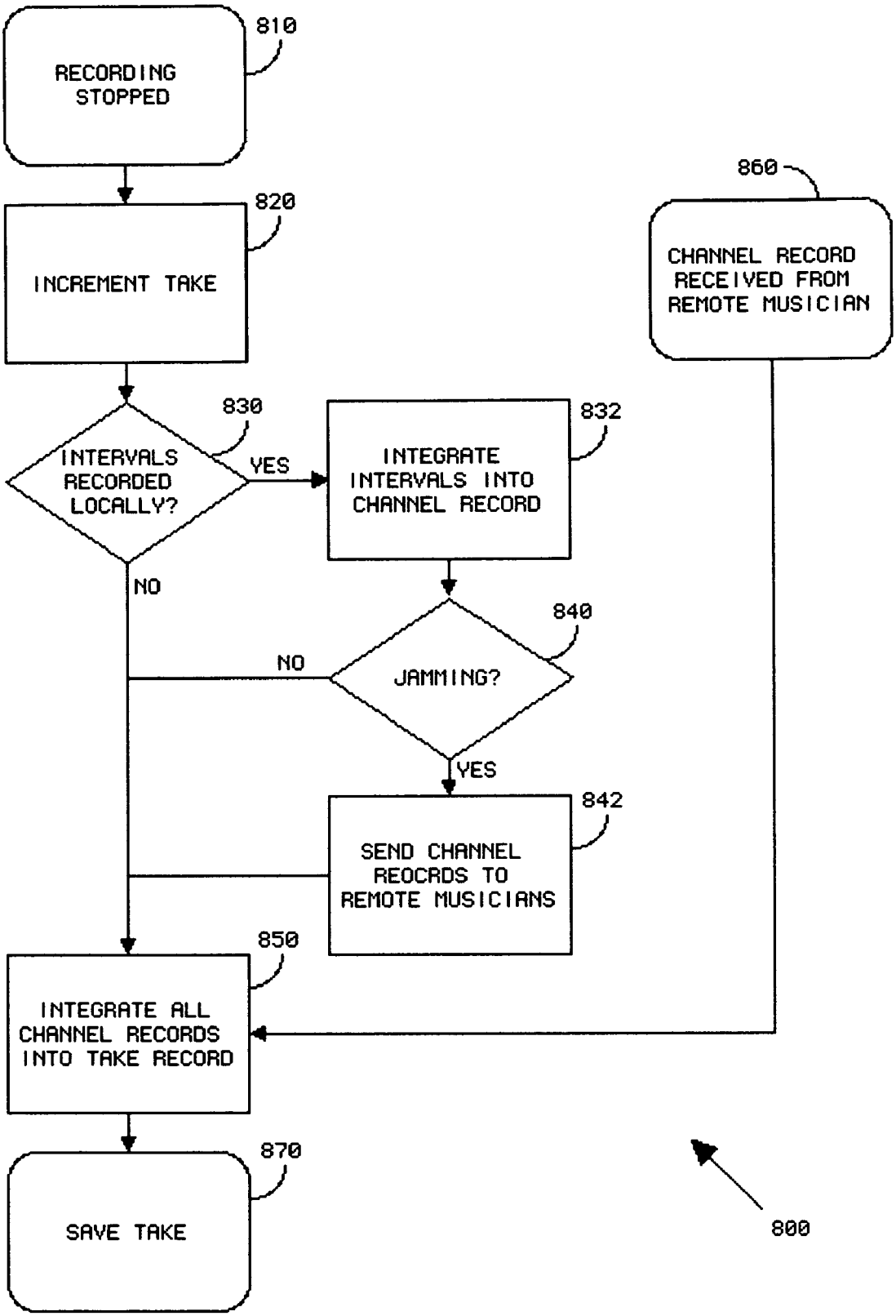
FIG. 8 is a flowchart of a process to restore the original fidelity to a distributed recording; and, FIG. 9 is a state transition diagram describing management of recordings of a live distributed performance.

FIG. 8 is a flowchart of a cleanup process 800 that can run once the transport exits RECORDING state 410 and returns to STOPPED state 420. Preferably, the transport is held in STOPPED state 420 until cleanup process 800 completes.

Cleanup process 800 preferably begins when the transport stops recording in step 810. Note that this represents a state transition of the transport, and does not relate to the status of any record select buttons 580. The number of the current take is incremented in step 820.

If no intervals have been recorded for all channels assigned to the local performance station 10, then there is no local cleanup to perform and advance to remote performance stations 12 & 14, so cleanup process 800 continues at step 850. This would be the case if for the entirety of the current take none of the record select buttons 580 for the locally assigned channels were active.

However, if any of the record select buttons 580 for locally assigned channels were active at any time during the most recent take, then one or more intervals will have resulted for each such channel and the process will continue at step 832.

The events captured in local recorded channel storage 125 are processed for each interval on each channel, according to the principles discussed in relation to FIG. 6, with RECORD_START 600 and RECORD_STOP 602 corresponding to the beginning and end of each corresponding interval. For instance, events 616, 626, 636, and 646 come from local recorded channel storage. Following step 832, these events will have been processed into composite musical event groups 610', 620', 630', and 640', respectively. These composite musical event groups represent musical events on each of four notes on the same channel in the same interval. Together, they represent the recording of a single channel following the current take. Alternatively, one or more of these groups may represent musical events occurring on a different channel, or during a different interval. The result is that each locally assigned channel may have been updated by the current take. Note that an update to a channel can occur by truncation and erasure, and not merely additional notes. For instance, musical event 622 is truncated during step 832 to become musical event of shorter duration 622'. Musical event 632 is completely without representation in resulting musical event group 630'.

In step 840, a determination is made whether remote performance stations 12 and 14 are present and need to be updated. If so, the resulting musical event groups, each preferably tagged with the current take number, are sent to the remote performance stations 12 and 14 in step 842. Preferably, the transmission of the cleanup data to remote performance stations is conducted using a reliable protocol, such as TCP/IP to ensure delivery.

Meanwhile, remote performance stations 12 and 14, if participating, are performing cleanup process 800 as well. As each completes step 842, the results are transmitted via communication channel 150 and received by local performance station 10 in step 860. As the cleanup for each channel is received and recognized by receiver 160, it is stored in remote recorded channel storage 195, preferably along with the corresponding take designation.

Once the clean up for all channels have been received, step 850 is complete and the entirety of the collaborative performance is preferably saved as a standard MIDI file in step 870. Note that the contents of local recorded channel storage 125 contains the full local performance with no thinning. When cleanup occurs in step 832, it is this fully nuanced performance that is used, and subsequently exchanged in step 842. Further, because the cleanup does not happen in real time, the record saved in step 870 is affected by neither network latency nor packet loss. The results in each participant in the collaboration receiving the performance the original musician intended.

The next time the transport enters PLAYING 430 or RECORDING 410 states, the data from the most recent takes for each channel are preferably used for playback on channels not muted and (if recording) not recorded selected.

Figure 9:
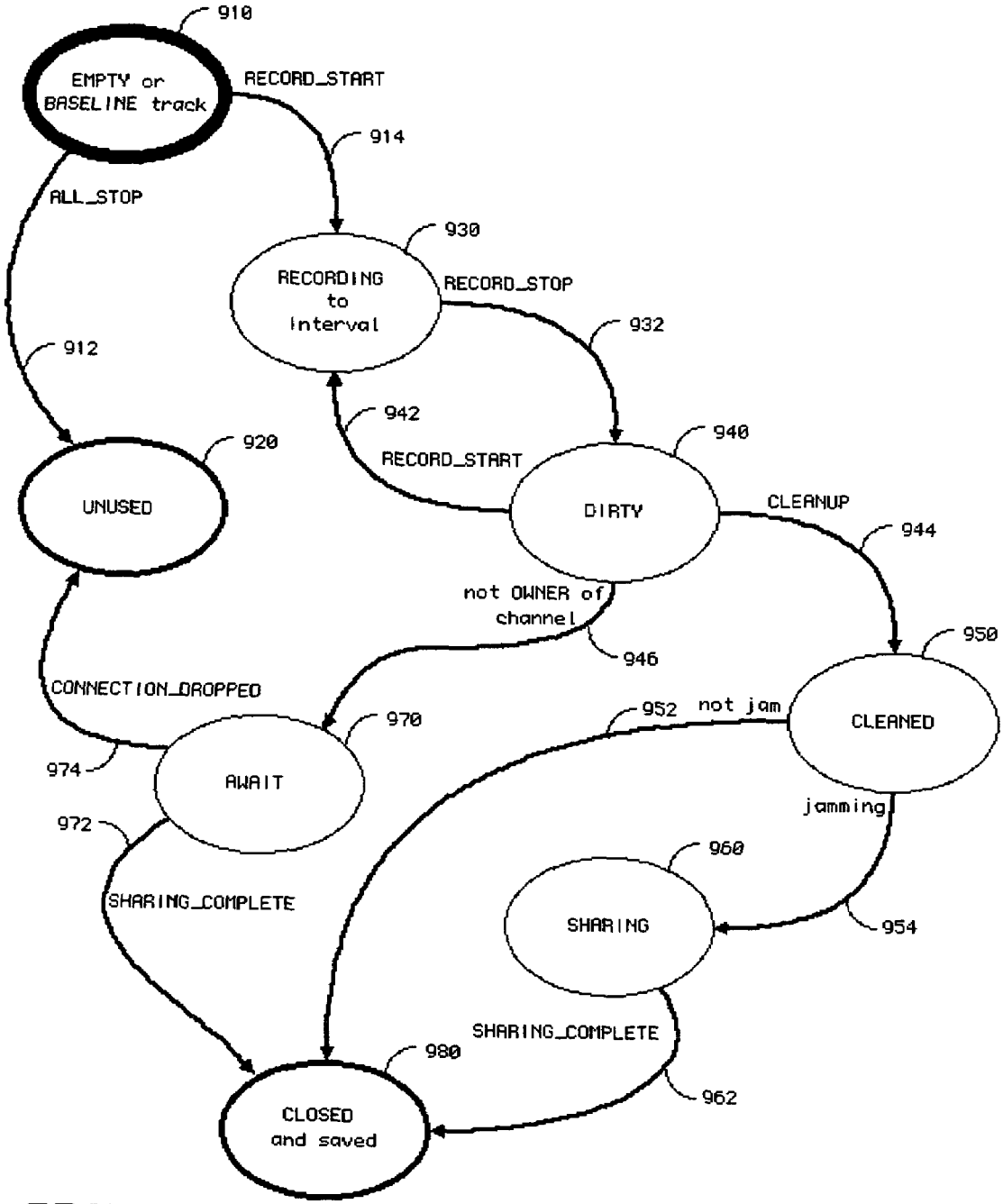

FIG. 9 represents a state diagram for each channel when the transport transitions to RECORDING state 410. In initial state 910, each track is either EMPTY or contains a BASELINE track, that is, previously recorded contents.

The RECORD_START event 914 occurs when the both the transport is in RECORDING state 410 and the channel's record select button 580 is active. Upon entry to RECORDING to Interval state 930, a new interval is created for the channel, and musical events on that channel are added to the interval. Each interval record is accumulated in local recorded channel storage 125.

RECORD_STOP event 932 closes the current interval on the channel and transitions to DIRTY state 940. This would occur if either the transport transitioned to STOPPED state 420, or the channel's record select button 580 was deactivated.

If RECORD_START event 942 occurs, which would only occur if the transport had remained in RECORDING state 410 and the channel's record select button 580 was re-activated, the channel returns to state 930.

Once the transport enters STOPPED state 820, those channels that never transitioned out of initial state 910, will experience the ALL_STOP event 912 and transition to the UNUSED state 920. No further activities will take place concerning such channels, until the next take.

For those channels achieving the DIRTY state 940 when the transport stops, one of two outcomes results: If the channel is not assigned to the local performance station 10, the Not Owner of Channel transition 946 take place immediately and the channel enters the AWAIT state 970. However, if the channel is assigned to the local performance station 10, the cleanup process of step 832 takes place. Upon completion of step 832, the CLEANUP event 944 occurs and the channel enters the CLEANED state 950.

From the CLEANED state 950, if not jamming with remote performance stations, transition 952 is taken to the CLOSED terminal state 980. Otherwise the jamming transition 954 is taken and the channel is in the SHARING state 960, where it remains until it has been shared with all remote performance stations resulting in the SHARING_COMPLETE event 962 to result in the channel being CLOSED 980.

For channels in the AWAIT state 970, the normal outcome is for the cleaned up channel data to be received from the remote performance station to which the channel is assigned. However, if something has gone wrong at the remote station, a timeout may result in the CONNECTION_DROPPED transition 974 advancing the channel to UNUSED terminal state 920. SHARING_COMPLETE event 962 may also result when the last remote performance station has timed out, and the attempt to share the channel with that station is aborted. This is the reflexive event to the CONNECTION_DROPPED event 974. When all channels are in terminal states 920 and 980, the cleanup integration step 850 is complete and the take can be saved in step 870.

The flowchart of cleanup process 800 and the state channel state transition diagram of FIG. 9 represent one embodiment of the cleanup process. Even for many minutes of jamming, empirical results indicate that the cleanup process will complete with several seconds. However, other cleanup processes may be used.

For example, a cleaned up version of the local performance can be sent in parallel with the live version. For instance, while the live version is sent to the remote stations over UDP/IP, a cleaned up version can be sent with a slight lag over a TCP/IP connection. Preferably, the UDP packets receive priority and are delivered without substantial waiting for the TCP packets. In this embodiment, the cleanup process will complete almost as soon as the transport stops.

In another embodiment, each musical event might receive a sequence number. The local performance station tracks sequence numbers for each remote performance station. When a packet is missing from the sequence after a sufficient delay, a request for the missing packet is issued and it is re-sent from the originating performance station to the requesting station.

Other cleanup methods and applicable reliable transport protocols will be apparent to those of ordinary skill in the art.

During a jam, it will usually be the case that communication channel 150 is the most efficient avenue available for communication between the participating musicians. As such, the ability for the musicians to communicate other than through musical events is highly desirable. Many techniques are well known in the prior art for a modem to allow voice, as well as data, communication. Too, Internet or other network connections with sufficient speed to permit a voice protocol are commonplace. For example, the inclusion of voice packets operable across common personal computer platforms is provided by certain of the GameSpy APIs.

A musician's voice is captured by a microphone (not shown) and digitized at remote station 12. Packets of the digitized voice, perhaps 1/10 of a second long, each, are compressed and buffered. When no musical events are pending, the next voice packet is inserted into the message stream at transmit module 130'. The voice packet is received at the local performance station 10. When it is identified by receive module 160, it is passed as a non-musical message to a voice packet buffer (not shown). When enough voice packets are received, a process (not shown) begins the decompression of the remote musician's voice, which is sent to audio output 190.

Preferably, the voice capture and transmit process is controlled using a conventional push-to-talk intercom switch. A good choice is to assign the spacebar of the keyboard as this intercom switch. Alternatively, a talk-to-talk mechanism can be used, where, if the audio level detected by the microphone exceeds some threshold, then voice packets start getting compressed and buffered for sending. If the audio level drops for too long a period of time, no more voice packets are prepared.

Preferably, because of the bandwidth consumed by transmitting and receiving voice packets, when the transport is in the RECORDPENDING state 422 or the RECORDING state 410, voice communication is curtailed. In the preferred embodiment, voice communication is forced into push-to-talk mode, since remaining in talk-to-talk may be inadvertently triggered by the sound of the music playing, or by musician's verbalizing their reaction to the music. Talk-to-talk, if selected, is restored when the transport leaves RECORDING state 410. In a more severe embodiment, all voice communication is halted while recording is in progress. If the bandwidth of the communication channel interface 140 and communication channel 150 is adequate, voice communication can be maintained even while recorded.

While the preferred embodiment is discussed in the context of present day GUI displays, keyboards, MIDI controllers, and communications channels, it is contemplated that other modes of input and communications will be suitable as they are made available.

The particular implementations described, and the discussions regarding details, and the specifics of the figures included herein, are purely exemplary; these implementations and the examples of them, may be modified, rearranged and/or enhanced without departing from the principles of the present invention.

The particular features of the user interface and the performance of the application, will depend on the architecture used to implement a system of the present invention, the operating system of the computers selected, the communications channel selected, and the software code written. It is not necessary to describe the details of such programming to permit a person of ordinary skill in the art to implement an application and user interface suitable for incorporation in a computer system within the scope of the present invention. The details of the software design and programming necessary to implement the principles of the present invention are readily understood from the description herein.

Various additional modifications of the described embodiments of the invention specifically illustrated and described herein will be apparent to those skilled in the art, particularly in light of the teachings of this invention. It is intended that the invention cover all modifications and embodiments that fall within the spirit and scope of the invention. Thus, while preferred embodiments of the present invention have been disclosed, it will be appreciated that it is not limited thereto but may be otherwise embodied within the scope of the following claims.

I claim as my invention:

1. A musical performance station for use by a musician, said station comprising:

a keyboard for the musician to play, said keyboard generating a first plurality of local musical events in response to being played by the musician, the local musical events representing a local contribution of the musician to a musical performance;

a communication channel interface, said interface providing access through a communication channel to at least one remote musical performance station, said access to each of the at least one remote musical performance station having an associated latency, said interface sending the first plurality of local musical events from the keyboard to the at least one remote musical performance station, said interface further receiving a second plurality of remote musical events from the at least one remote musical performance station;

a delay, said delay having a non-zero local delay value, said delay receiving each of said first plurality of local musical events from the keyboard and holding each of said first plurality of local musical events for a first amount of time specified by the local delay value, said delay further having a remote delay value associated with each of the at least one remote musical performance station, said delay receiving each of said second plurality of remote musical events from the communication channel interface and holding each of said second plurality of remote musical events for a second amount of time specified by the remote delay value associated with the remote musical performance station which originated each of the remote musical events;

a synthesizer for rendering musical events into an audio signal, said synthesizer receiving each of said first plurality of local musical events from the delay when the first amount of time corresponding to each of the local musical events has elapsed, and rendering each of the local musical events into the audio signal, said synthesizer receiving each of the remote musical events from the delay when the second amount of time corresponding to each of the remote musical events has elapsed, and rendering each of the remote musical events into the audio signal;

a first storage, said first storage storing first data representative of each of said first plurality of local musical events;

a clock, said clock providing for each of said first plurality of local musical events a corresponding local event time, each local event time having a first substantial correspondence to when said first amount of time has elapsed for the corresponding local musical event, said first data being further representative of the corresponding local event time;

said interface further re-sending at least a portion of said first data from said first storage to the remote musical performance station as a first cleanup; and, a second storage, for storing a second data from each of said at least one remote musical performance station, said second data representative of a third plurality of remote musical events each having a corresponding remote event time, the remote event times having a second substantial correspondence to said clock, said third plurality of remote musical events including at least said second plurality of remote musical events, said third plurality of remote musical events representing a substantially complete remote contribution to the musical performance, said interface further receiving at least those remote musical events of said third plurality not included in the second plurality to provide a second cleanup;

whereby said first storage and said second storage record the musical performance.

2. The station of claim 1, wherein said second plurality of remote musical events comprises at least one transport command selected from the group consisting of record, stop, play, pause, rewind, and fast-forward.

3. The station of claim 1, wherein said first plurality of local musical events comprises at least one transport command selected from the group consisting of record, stop, play, pause, rewind, and fast-forward.

4. The station of claim 1, wherein a difference between the third plurality and the second plurality at least partially represents a thinning of remote musical events.

5. The station of claim 4, wherein said thinning affects at least a portion of remote nuance events selected from the group comprising aftertouch, pitchbend, and continuous control.

6. The station of claim 1, wherein said keyboard generates a fourth plurality of local musical events, said first storage further storing third data representative of each of said fourth plurality of local musical events, said interface further sending said third data from said first storage to the remote musical performance station as a further portion of said first cleanup, said first plurality of local musical events and said fourth plurality of local musical events together representing a substantially complete local contribution to the musical performance;

whereby said local contribution is thinned, but said first storage records and shares a substantially complete musical performance.

7. The station of claim 6, wherein said fourth plurality of local musical events comprises at least a portion of local nuance events selected from the group comprising aftertouch, pitch-bend, and continuous controller events.

8. The station of claim 1, wherein a difference between the third plurality and the second plurality is at least partially caused by said communication channel being lossy.

9. The station of claim 1, said station further comprising a detector for determining a status of said keyboard, wherein said first plurality of local musical events comprises at least one all-notes-off command generated by said detector in response the status of said keyboard being all notes off.

10. The station of claim 1, said station further comprising a groove track, said groove track playing back during said musical performance with a predetermined relationship to a transport play command.

11. The station of claim 10, wherein said groove track is comprised of at least one of the group consisting of a metronome, and a previously recorded song.

12. The station of claim 1, wherein said communication channel is the Internet.

13. A musical performance station for use by a musician, said station comprising:

a keyboard for the musician to play, said keyboard generating a first plurality of local musical events in response to being played by the musician, the local musical events representing a local contribution of the musician to a musical performance;

a communication channel interface, said interface providing access through a communication channel to at least one remote musical performance station, said access to each of the at least one remote musical performance station having an associated latency, said interface sending the first plurality of local musical events to the at least one remote musical performance station, said interface further receiving a second plurality of remote musical events from the at least one remote musical performance station, said interface further providing access through said communication channel to an engineer station having a storage for capturing the musical performance, said interface further sending the first plurality of local musical events to said engineer station using a reliable protocol, said engineering station further receiving at least said second plurality of remote musical events from the at least one remote musical performance station using the reliable protocol, the remote musical events representing a remote contribution to the musical performance;

a delay, said delay having a nonzero local delay value, said delay receiving each of said first plurality of local musical events from the keyboard and holding each of said first plurality of local musical events for a first amount of time specified by the local delay value, said delay further having a remote delay value associated with each of the at least one remote musical performance station, said delay receiving each of said second plurality of remote musical events from the communication channel interface and holding each of said second plurality of remote musical events for a second amount of time specified by the remote delay value associated with the remote musical performance station which originated each of the remote musical events;

a synthesizer for rendering musical events into an audio signal, said synthesizer receiving each of said first plurality of local musical events from the delay when the first amount of time corresponding to each of the local musical events has elapsed, and rendering each of the local musical events into the audio signal, said synthesizer receiving each of the remote musical events from the delay when the second amount of time corresponding to each of the remote musical events has elapsed, and rendering each of the remote musical events into the audio signal;

wherein said storage records the musical performance.

14. A method for recording a distributed musical performance comprising the steps of:

a) providing a musical performance station for use by a musician, said music performance station comprising a keyboard for the musician to play, said keyboard generating local musical events in response to being played by the musician, the local musical events representing a local contribution of the musician to a musical performance, said local performance station having a local interface to a communication channel, said local performance station further having a synthesizer, said synthesizer rendering said local musical events after a delay;

b) providing at least one remote musical performance station, each of said remote musical performance stations having a corresponding interface with said communication channel, each of said remote musical performance station producing remote musical events;

c) recording said local musical events;

d) sending at least a portion of said local musical events to each remote musical performance station through said communication channel in real time;

e) receiving at least a portion of said remote musical events from each remote musical station through said communication channel in real time;

f) rendering said at least a portion of said remote musical events with said synthesizer; and, g) recording said at least a portion of said remote musical events;

whereby step c) and step g) records the musical performance.

15. The method of claim 14 wherein said communication channel comprises the Internet.

16. The method of claim 14, wherein sending step d) is performed using a reliable protocol.

17. The method of claim 14, wherein in sending step d) said at least a portion of said local musical events is a thinned portion of said local musical events.

18. The method of claim 17, wherein said thinned portion of said local musical events excludes at least one event selected from the group consisting of aftertouch, pitchbend, and continuous control.

19. The method of claim 14, further comprising the steps of:

h) sending at least the local musical events not sent in step d) to each remote musical performance station through said communication channel;

i) receiving the remote musical events not received in step e) from each remote musical station through said communication channel; and, wherein recording step g) further comprises recording the remote musical events received in step i).

20. The method of claim 14, wherein in receiving step e) said at least a portion of said remote musical events is thinned.

* * * * *